US010857818B2

(12) United States Patent
Ogimoto et al.

(10) Patent No.: US 10,857,818 B2
(45) Date of Patent: Dec. 8, 2020

(54) TABLET PRINTING APPARATUS AND TABLET PRINTING METHOD

(71) Applicant: SHIBAURA MECHATRONICS CORPORATION, Yokohama (JP)

(72) Inventors: Shinichi Ogimoto, Yokohama (JP); Ryo Ikuta, Yokohama (JP); Yutaka Okabe, Yokohama (JP); Hitoshi Aoyagi, Yokohama (JP); Hikaru Hoshino, Yokohama (JP)

(73) Assignee: SHIBAURA MECHATRONICS CORPORATION, Yokohama (JP)

( * ) Notice: Subject to any disclaimer, the term of this patent is extended or adjusted under 35 U.S.C. 154(b) by 100 days.

(21) Appl. No.: 15/570,008

(22) PCT Filed: Apr. 27, 2016

(86) PCT No.: PCT/JP2016/063274

§ 371 (c)(1),
(2) Date: Oct. 27, 2017

(87) PCT Pub. No.: WO2016/175259

PCT Pub. Date: Nov. 3, 2016

(65) Prior Publication Data

US 2018/0154659 A1 Jun. 7, 2018

(30) Foreign Application Priority Data

Apr. 30, 2015 (JP) ..... 2015-093733
Oct. 23, 2015 (JP) ..... 2015-209414

(51) Int. Cl.
*B41J 2/01* (2006.01)
*B41J 11/00* (2006.01)
(Continued)

(52) U.S. Cl.
CPC ..... *B41J 11/0085* (2013.01); *A61J 3/06* (2013.01); *B41J 2/01* (2013.01); *B41J 3/407* (2013.01);
(Continued)

(58) Field of Classification Search
CPC . B41J 11/00; B41J 11/0085; B41J 2/01; B41J 3/407; B41J 11/007; B41J 11/0095; B41J 11/42; B61J 3/06; A61J 3/06
See application file for complete search history.

(56) References Cited

U.S. PATENT DOCUMENTS 5,423,252 A 6/1995 Yamamoto et al.
6,390,618 B1 * 5/2002 Wotton ..... B41J 11/002 347/102
(Continued)

FOREIGN PATENT DOCUMENTS

JP 6-143539 A 5/1994
JP 2006-341561 A 12/2006
(Continued)

OTHER PUBLICATIONS

International Search Report dated Jul. 26, 2016, in PCT/JP2016/063274 filed Apr. 27, 2016.

*Primary Examiner* — Matthew J Daniels
*Assistant Examiner* — Shibin Liang
(74) *Attorney, Agent, or Firm* — Oblon, McClelland, Maier & Neustadt, L.L.P.

(57) ABSTRACT

According to one embodiment, a tablet printing apparatus includes: a conveyor configured to convey tablets sequentially supplied thereto while sucking and holding the tablets by a suction chamber 14; a print head located to face the conveyor and configured to elect ink to the tablet conveyed by the conveyor to perform printing; and partition walls 144, 144 and suction paths 1421, 1422 that serve as a suction
(Continued)

force adjusting device configured to reduce a suction force applied to the tablet at a conveyance position facing the print head to be lower than a suction force applied to the tablet at conveyance positions in front of and behind the conveyance position.

10 Claims, 13 Drawing Sheets

(51) Int. Cl.
*A61J 3/06* (2006.01)
*B41J 3/407* (2006.01)
*B41J 11/42* (2006.01)

(52) U.S. Cl.
CPC ..... *B41J 11/007* (2013.01); *B41J 11/0095* (2013.01); *B41J 11/42* (2013.01)

(56) References Cited

U.S. PATENT DOCUMENTS

| | | | | |
|---|---|---|---|---|
| 6,409,332 | B1 * | 6/2002 | Yraceburu | B41J 11/007 271/197 |
| 7,182,018 | B2 * | 2/2007 | Ackley, Jr. | A23G 3/28 101/35 |
| 2006/0279752 | A1 | 12/2006 | Hatasa et al. | |
| 2009/0244242 | A1 | 10/2009 | Sawada | |
| 2014/0168309 | A1 | 6/2014 | Morita et al. | |
| 2015/0174916 | A1 | 6/2015 | Hara et al. | |
| 2015/0191028 | A1 | 7/2015 | Hara et al. | |
| 2017/0182820 | A1 * | 6/2017 | Nakano | A61J 3/00 |

FOREIGN PATENT DOCUMENTS

| | | | | |
|---|---|---|---|---|
| JP | 2007-76175 | A | 3/2007 | |
| JP | 3135376 | U | 9/2007 | |
| JP | 2012153048 | * | 1/2011 | B41J 11/02 |
| JP | 2012-153048 | A | 8/2012 | |
| JP | 2013-013711 | A | 1/2013 | |
| JP | WO2014/013974 | A1 | 1/2014 | |
| JP | 2014-124830 | A | 7/2014 | |
| JP | 2014-210364 | A | 11/2014 | |

* cited by examiner

TABLET PRINTING APPARATUS AND TABLET PRINTING METHOD

TECHNICAL FIELD

Embodiments described herein relate generally to a tablet printing apparatus and a tablet printing method.

BACKGROUND ART

For example, a tablet printing apparatus or the like may be cited as a device for printing letters or characters, marks, and the like on the surface of a solid preparation such as a tablet (hereinafter referred to as "tablet"). In the tablet printing apparatus, a transfer printing is performed on a tablet using a roller provided with a transferred pattern on its surface. At this time, the tablet is held in a pocket by the suction of air. Thereby, displacement and the like are suppressed, and ink transfer is performed satisfactorily.

Regarding a printing method, in addition to the apparatus that uses a roller described above, there is also known an apparatus that uses an inkjet print head (hereinafter simply referred to as "print head"), for example, because of the ease in changing a print pattern or the like. When printing is performed on a tablet using the print head, if the tablet is sucked and held by the suction of air as described above, depending on the shape of the tablet, the manner of sucking, and the like, as the air around the tablet is sucked, airflow is generated around the tablet.

When the airflow reaches the nozzle that ejects ink, the ink around and in the nozzle is likely to dry. For example, ink cannot be ejected at the time of ink ejection, or the ejection direction is shifted, resulting in degradation of print quality.

PRIOR ART DOCUMENT

[Patent Document]

[Patent Document 1] Japanese Unexamined Patent Application Publication No. Hei06-143539

SUMMARY OF THE INVENTION

Problems to be Solved by the Invention

An object of the present invention is to provide a tablet printing apparatus and a tablet printing method capable of maintaining print quality by appropriately controlling the suction of air for sucking and holding a tablet.

Means of Solving the Problems

According to one embodiment, a tablet printing apparatus includes: a conveyor configured to convey tablets sequentially supplied thereto while sucking and holding the tablets; a print head located to face the conveyor and configured to eject ink to the tablet conveyed by the conveyor to perform printing; and a suction force adjusting device configured to reduce a suction force applied to the tablet at a conveyance position facing the print head to be lower than a suction force applied to the tablet at conveyance positions in front of and behind the conveyance position.

According to another embodiment, a tablet printing method includes: conveying tablets sequentially supplied while sucking and holding the tablets; ejecting ink to the tablet conveyed as being sucked and held to perform printing; and reducing a suction force applied to the tablet at a conveyance position where the printing is performed to be lower than a suction force applied to the tablet at conveyance positions in front of and behind the conveyance position.

Effects of the Invention

According to the embodiments, it is possible to provide a tablet printing apparatus and a tablet printing method capable of maintaining print quality by appropriately controlling the suction of air for sucking and holding a tablet.

MODES FOR CARRYING OUT THE INVENTION

Embodiments of the present invention will be described in detail below with reference to the drawings.

First Embodiment

Figure 1:
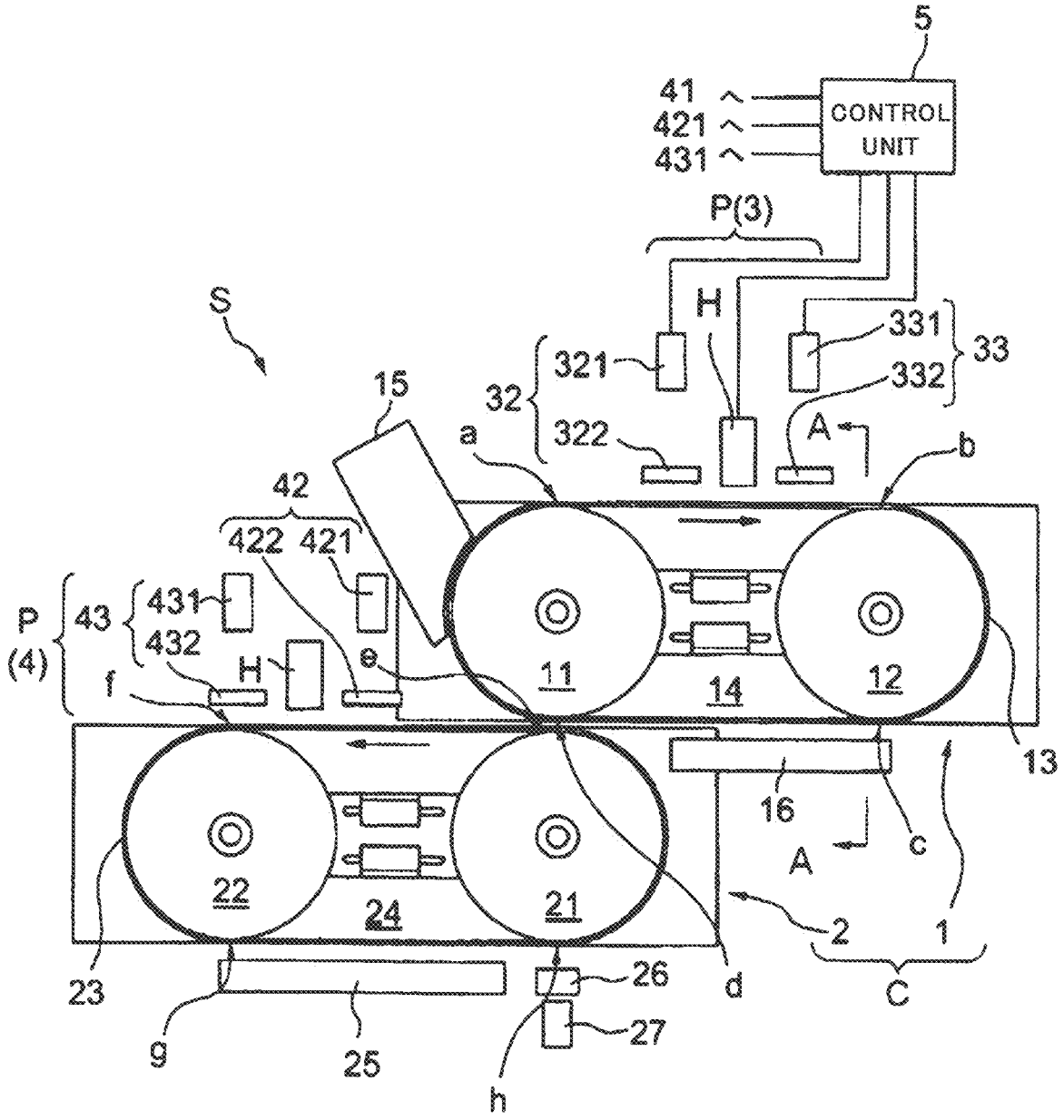
FIG. 1 is a front view illustrating the overall configuration of a tablet printing apparatus according to a first embodiment.

FIG. 1 is a front view illustrating the overall configuration of a tablet printing apparatus S according to a first embodiment. The tablet printing apparatus S includes a conveyor C for conveying tablets to be printed and a printing unit P for printing on the tablets conveyed by the conveyor C.

As illustrated in FIG. 1, the tablet printing apparatus S is configured so that the conveyor C includes a first conveyor 1 and a second conveyor 2 which are arranged one above the other to perform printing on both sides of a tablet. The printing unit P includes a first printing unit 3 and a second printing unit 4. The first printing unit 3 is arranged so as to face the first conveyor 1, and the second printing unit 4 is arranged so as to face the second conveyor 2. That is, the first printing unit 3 is located above the first conveyor 1, and the second printing unit 4 is located above the second conveyor 2. Thus, the tablet printing apparatus S as a whole is constituted.

In first embodiment, the first conveyor 1 and the second conveyor 2, or the first printing unit 3 and the second printing unit 4 have basically the same configuration. Therefore, in the following, the first conveyor 1 and the first printing unit 3 will be described as examples to explain the conveyor C and the printing unit P.

The first conveyor 1 includes a first pulley 11, a second pulley 12, an endless conveyor belt 13, and a suction chamber 14.

The first pulley 11 is a left pulley of the two pulleys illustrated as circles in the first conveyor 1 in FIG. 1. A drive source is not particularly connected to the first pulley 11. The first pulley 11 is a driven pulley that is rotated with the rotation of the second pulley 12 through the conveyor belt 13.

The second pulley 12 is a right pulley of the two pulleys illustrated in FIG. 1. In the first embodiment, the second pulley 12 is connected to a drive source, and serves as a driving pulley.

The conveyor belt 13 is wrapped around the first pulley 11 and the second pulley 12. The conveyor belt 13 is provided with no end, portion and is endless. Thus, the conveyor belt 13 rotates as the first pulley 11 and the second pulley 12 rotate.

In the first embodiment, both the first pulley 11 and the second pulley 12 rotate clockwise. Accordingly, in the first conveyor 1, the conveyor belt 13 moves in a direction indicated by the solid arrow in the upper horizontal region, i.e., rightward from the first pulley 11 to the second pulley 12.

Figure 2:
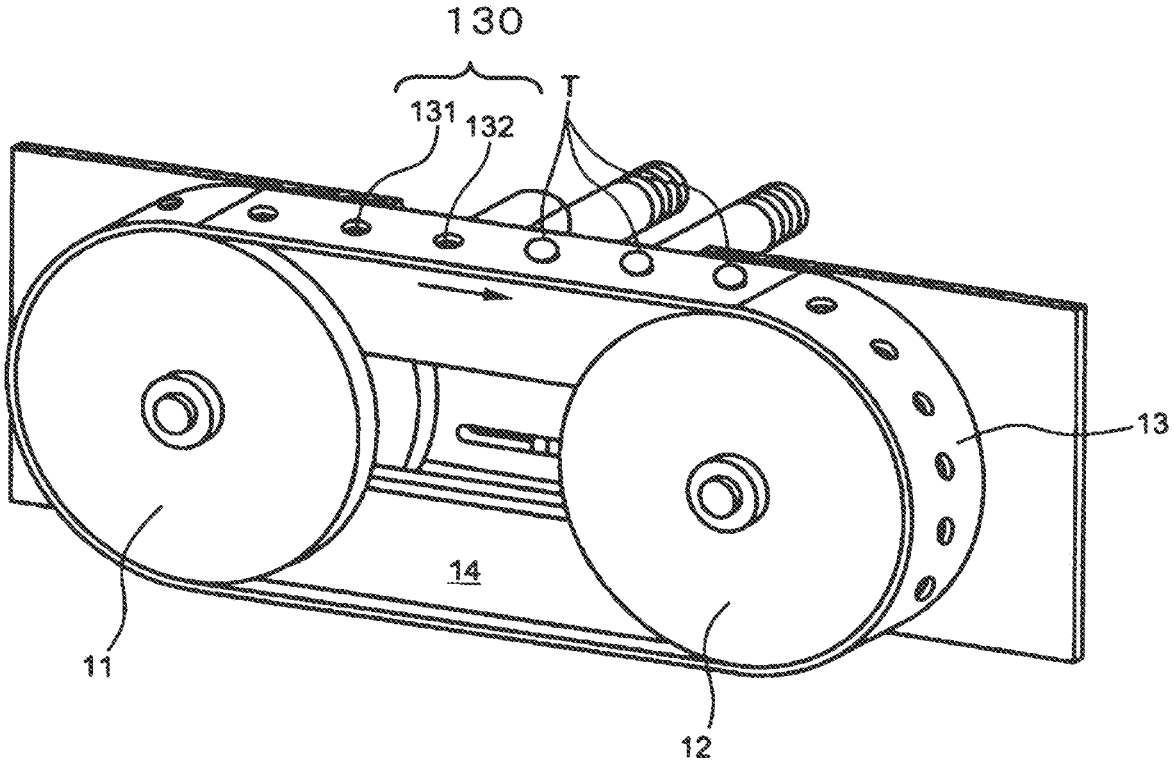
FIG. 2 is a perspective view illustrating the overall configuration of a conveyor according to the first embodiment.

The configuration of the conveyor belt 13 will be described more specifically with reference to FIGS. 2 and 3. FIG. 2 is a perspective view illustrating the overall configuration of the first conveyor 1 of the first embodiment, FIG. 3 is a cross-sectional view of the tablet printing apparatus taken along the line A-A in FIG. 1 in the tablet printing apparatus S of the first embodiment.

Figure 3:
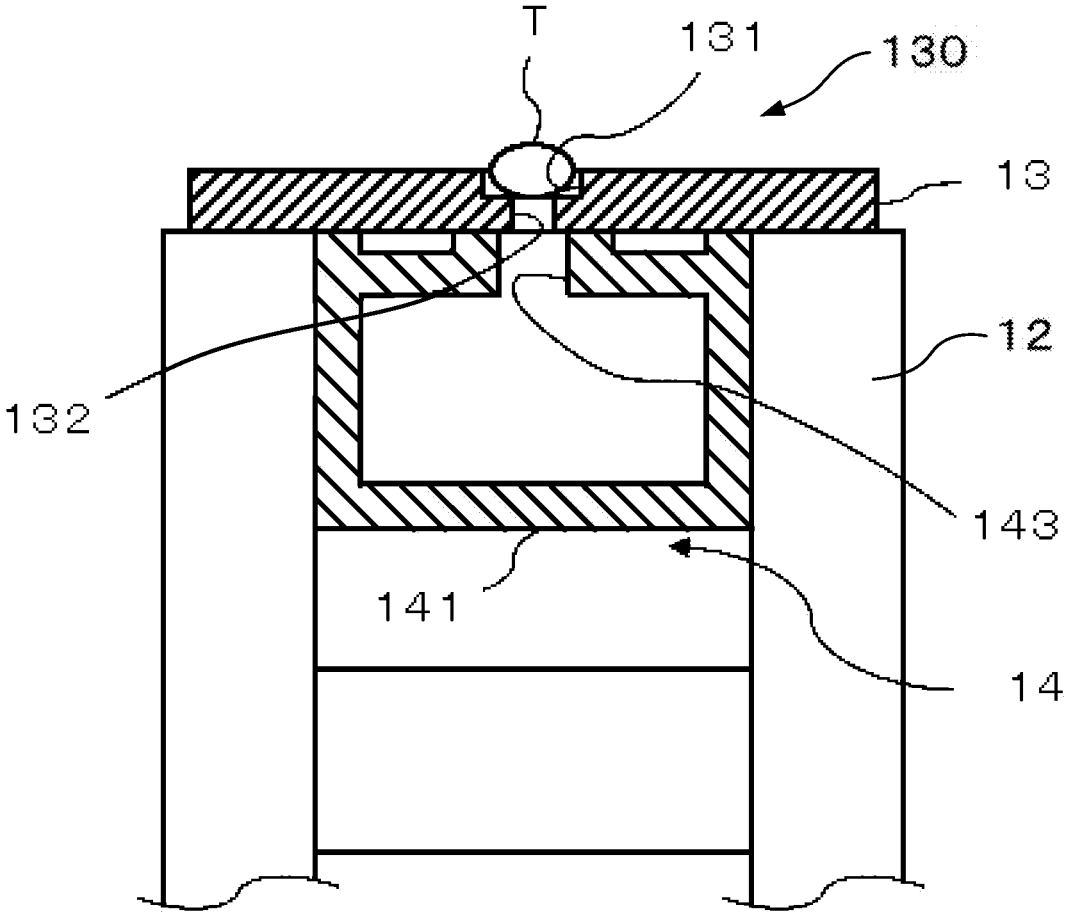
FIG. 3 is a partially cutaway cross-sectional view of the tablet printing apparatus taken along the line A-A in FIG. 1 in the tablet printing apparatus of the first embodiment.

Incidentally, the left side in FIG. 3 corresponds to the front side of the first conveyor 1 illustrated in FIG. 1. In FIG. 3, the second pulley 12 is illustrated without being sectioned. In FIG. 3, the upper side across the rotation axis of the second pulley 12 indicates a position where the conveyor belt 13 comes in contact with the second pulley 12 after the tablet T is printed in the first printing unit 3 and passes under a printing state checking device 33, i.e., a portion denoted by reference letter b in FIG. 1.

As illustrated in FIG. 2, on the surface of the conveyor belt 13, a plurality of suction portions 130 for suctioning tablets T to be printed are formed at equal intervals over the entire circumference of the endless conveyor belt 13. A part of FIG. 2 illustrates a state where the tablets T are suctioned by the suction portions 130.

As illustrated in FIG. 3, the suction portion 130 includes a recess 131 such as a pocket for housing the tablet T and a suction hole 132 continuous to the bottom surface of the recess 131. The suction hole 132 is formed in the bottom of the recess 131 from the bottom surface of the recess 131 of the conveyor belt 13 toward the rear surface side of the conveyor belt 13. That is, a through hole is formed in the conveyor belt 13. The suction of air by the suction chamber 14 (described later) acts on the tablet T stored in the recess 131 through the suction hole 132, and the tablet T is sucked and held on the conveyor belt 13.

As illustrated in FIG. 2, the suction chamber 14 is arranged inside of the conveyor belt 13 over the entire circumference of the conveyor belt 13. The suction chamber 14 is configured to be capable of applying a suction force to the suction portion 130 of the conveyor belt 13 (details will be described later).

Referring back to FIG. 1, the first printing unit 3 is located at a position facing the surface of the conveyor belt 13 that moves from the first pulley 11 toward the second pulley 12. In other words, the first printing unit 3 is arranged to face a region where the conveyor belt 13 moves from the first pulley 11 to the second pulley 12 (a horizontal portion on the upper side of the conveyor belt 13 between reference letters a and b in FIG. 1).

The first printing unit includes an inkjet print head H configured to perform printing on the tablet T, position detector 32 configured to detect the position of the tablet T, and the printing state checking device 33 configured to check the state of printing on the tablet T.

The position detector 32 is located on the upstream side of the print head H in the traveling direction of the conveyor belt 13 (the conveyance direction of the tablet T). The position detector 32 is configured to detect the position, orientation, and front/back of the tablet T to check whether the tablet T is properly stored in the recess 131 formed in the surface of the conveyor belt 13. The position detector 32 includes an imaging device 321 configured to photograph the tablet T and an illumination 322 configured to illuminate the tablet T to be photographed. The imaging device 321 captures an image of the tablet T, takes in the image, and sends it to a control unit 5.

As an example, the control unit 5 serves a part of the configuration of the first printing unit 3 (the position detector 32). The control unit 5 calculates and detects posture, information regarding the position, orientation, and front/back of the tablet T from the image received from the imaging device 321. Then, the control unit 5 drives the print head H to perform appropriate printing based on the detection result (if misalignment has occurred, printing is performed after correcting the misalignment or adjusting the orientation). Besides, for example, when the amount of the misalignment exceeds an allowable value, the control unit 5 determines not to perform printing.

The printing state checking device 33 is located on the downstream side of the print head H in the traveling direction of the conveyor belt 13 to check the state of printing on the upper surface of the tablet T applied by the print head H. The printing state checking device 33 includes an imaging device 331 configured to photograph the state of printing on the tablet T and an illumination 332 configured to illuminate the tablet T to be photographed. The imaging device 331 captures an image of the tablet T, takes in the image, and sends it to the control unit 5.

Accordingly, as an example, the control unit 5 also serves a part of the configuration of the first printing unit 3 (the printing state checking device 33). The control unit 5 detects the printing state based on the image captured, and determines whether printing is good or not. As will be described later, the tablet T determined to be defective in printing is sent to a defective product collection box.

A tablet supply device 15 is provided on the left side of the first pulley 11 of the first conveyor 1 described above. The tablet supply device 15 contains a large number of tablets T, and is configured to be capable of supplying the tablets T one by one to the recesses 131 in the conveyor belt 13.

A drying device 16 is provided on the lower side of the first conveyor 1 to dry the ink on the tablets T after printing. The drying device 16 is arranged to face a region where the conveyor belt 13 moves from the second pulley 12 to the first pulley 11 (a horizontal portion on the lower side of the first conveyor 1 between reference letters c and d in FIG. 1). That is, the drying device 16 is located at a position facing the conveyor belt 13. For example, the drying device 16 blows hot air to the tablets T to dry the ink printed on the tablets T.

Note that the drying device 16 may be arranged in any position as long as it can dry the ink printed on the tablets T without interfering with other mechanisms constituting the tablet printing apparatus S. In this embodiment, the drying device 16 is located between position c where the conveyor belt 13, which reversely rotates along with the rotation of the second pulley 12, is separated from the second pulley 12 toward the first pulley 11 and a position where it does not interfere with the movement of a first pulley 21 in the second conveyor 2.

As illustrated in FIG. 1, the first conveyor 1 is arranged in an upper portion of the tablet printing apparatus S, and the second conveyor 2 is arranged in lower portion of the tablet printing device S. The second conveyor 2 conveys the tablet T with one surface (front surface) printed by the first printing unit 3 so that the other surface (back surface) of the tablet T is printed by the second printing unit 4.

The second conveyor 2 is basically the same as the first conveyor 1 as described above. That is, the second conveyor 2 includes the first pulley 21 as a driven pulley, a second pulley 22 as a drive source, an endless conveyor belt 23, and a suction chamber 24.

The first pulley 21 and the second pulley 22 rotate counterclockwise. Accordingly, the conveyor belt 23 wound around the pulleys 21 and 22 rotates to the left. That is, in FIG. 1, the conveyor belt 23 moves in the direction indicated by the arrow illustrated in the horizontal region on the upper side of the second conveyor 2, i.e., leftward.

The conveyor belt 23 conveys the tablets T as the first pulley 21 and the second pulley 22 rotate. On the surface of the conveyor belt 23, similarly to the conveyor belt 13, a suction portion (see the suction portion 130 in FIGS. 2 and 3) is formed for sucking the tablet T to the belt surface by storing the tablet T in a recess.

The conveyor belt 23 faces the conveyor belt 13 of the first conveyor 1 on the downstream side of the drying device 16 of the first conveyor 1. Therefore, in a region where the conveyor belt 13 of the first conveyor 1 meets the conveyor belt 23 of the second conveyor 2, both of them move in the same direction, i.e., to the left in FIG. 1.

If the conveyor belt 13 of the first conveyor 1 and the conveyor belt 23 of the second conveyor 2 convey the tablets T at the same speeds, the relative speed of them is zero. Accordingly, by synchronizing the conveying speeds of the conveyor belt 13 and the conveyor belt 23 so as to match the positions of the recesses of both, it is possible to smoothly deliver the tablets T from the first conveyor 1 to the second conveyor 2.

In the first embodiment, the first pulley 11 of the first conveyor 1 and the first pulley 21 of the second conveyor 2 are positioned such that their axes are aligned in the vertical direction. Thus, the tablets T are transferred in a position where the conveyor belt 13 comes in contact with the first pulley 11 of the first conveyor 1 (the position indicated by reference letter d in FIG. 1), and where the conveyor belt 23 is separated from the first pulley 21 of the second conveyor 2 (the position indicated by reference sign d in FIG. 1).

However, the positional relationship between the first pulley 11 of the first conveyor 1 and the first pulley 21 of the second conveyor 2 is not limited to that as in the first embodiment, and their positions may be misaligned. That is, the first pulley 21 of the second conveyor 2 may be shifted to the right side in FIG. 1 from the first pulley 11 of the first conveyor 1, and the conveyor belt 13 of the first conveyor 1 and the conveyor belt 23 of the second conveyor 2 may horizontally face each other. The tablets T are transferred at the portion where the conveyor belts 13 and 23 overlap one above the other.

When the conveyor belt 23 is viewed from above, the tablet T transferred from the first conveyor 1 to the second conveyor 2 is stored in the recess 131 of the conveyor belt 23 such that the surface printed by the first printing unit 3 faces the bottom of the recess 131 (see FIG. 3), and the opposite surface is exposed.

Similarly to the suction chamber 14 described above, the suction chamber 24 is arranged inside of the conveyor belt 23 over the entire circumference of the conveyor belt 23. The suction chamber 24 is configured to be capable of applying a suction force to a suction portion illustrated of the conveyor belt 23.

The second conveyor 2 employs the above configuration. Meanwhile, as illustrated in FIG. 1, the second printing unit 4 is arranged to face the second conveyor 2 in an upper part thereof. That is, the second printing unit 4 is arranged to face a region where the conveyor belt 23 moves from the first pulley 21 to the second pulley 22 (a horizontal portion on the upper side of the conveyor belt 23 between reference letters e and f in FIG. 1).

Similarly to the first printing unit 3, the second printing unit 4 includes a print head H configured to perform printing on the tablet T, a position detector 42 located on the upstream side of the print head H in the traveling direction of the conveyor belt 23, and a printing state checking device 43 located on the downstream side of the print head H in the traveling direction of the conveyor belt 23.

The position detector 42 includes an imaging device 421 configured to photograph the tablet T and an illumination 422 configured to illuminate the tablet T to be photographed. The printing state checking device 43 includes an imaging device 431 configured to photograph the state of printing on the tablet T and an illumination 432 configured to illuminate the table T to be photographed. The imaging device 431 and the illumination 432 are also controlled by the control unit 5 as with the first printing unit 3.

Further, a drying device 25 is provided on the lower side of the second conveyor 2 to dry the ink on the tablets T after printing. That is, the drying device 25 is arranged to face a region where the conveyor belt 23 moves from the second pulley 22 to the first pulley 21 (a region between reference letters g and h in FIG. 1).

Note that, as with the location of the drying device 16, the drying device 25 may be arranged in any position as long as it can dry the ink printed on the tablets T without interfering with other mechanisms constituting the tablet printing apparatus S.

On the downstream side of the drying device 25 of the second conveyor 2, boxes 26 and 27 are provided to collect the tablets T, which have their upper and lower surfaces printed, depending on whether printing is good or not. The control unit 5 determines whether printing is good or not for each tablet based on the check result from the printing state checking device 33 and the printing state checking device 43.

For example, when it is determined that the printing state is appropriate, the tablet T is sent from the conveyor belt 23 to the non-defective product collection box 26 as a non-defective product. On the other hand, if it is determined that the printing state is inappropriate, the tablet is sent from the conveyor belt 23 to the defective product collection box 27 as a defective product. Defective products may be collected, for example, by blowing air against the tablet T while it is falling from the conveyor belt 23 to the non-defective product collection box 26 so as to store the defective tablet in the defective product collection box 27.

The control unit 5 controls each unit of the tablet printing apparatus S. Although not illustrated in FIG. 1, for example, an input unit for providing various types of print information and the like, and a display unit for displaying input results, print results, and the like may be connected to the control unit 5. In FIG. 1, only the control unit 5 and the each unit of the printing unit P are electrically connected. However, since the control unit 5 controls each unit of the tablet printing apparatus S as described above, other units are also electrically connected to the control unit 5.

(Printing Process)

In the following, with reference to FIG. 1, the process of printing on the tablet T with the tablet printing apparatus S will be described in order.

First, the tablets T stored in the tablet supply device 15 are sequentially supplied to the first pulley 11 of the first conveyor 1 rotating in the right direction. The tablets T sequentially supplied from the tablet supply device 15 are sequentially stored one by one in each of the recesses 131 in the conveyor belt 13.

The tablet T is supplied from the tablet supply device 15 at the position illustrated in FIG. 1. The suction chamber 14 applies a suction force to the suction portion 130, and thereby the tablet. T in the recess 131 is sucked and held in the recess 131 without dropping therefrom. Incidentally, the term "sucked and held" refers to holding by suction.

The tablets T are sequentially conveyed as being stored in the recesses 131 in the conveyor belt 13 by the suction chamber 14. The first printing unit 3 located on the upper side of the first conveyor 1 prints letters, characters, graphics or the like on the upper surface of each of the tablets T. The letters characters, graphics or the like are set in advance.

Specifically, first, the position detector 32 checks the position of the tablet T stored in the recess 131 of the conveyor belt 13. The position of the tablet T and the recess 131 photographed by the imaging device 321 is sent to the control unit 5 to determine whether printing is possible or not.

Besides, in the case where the tablet T to be printed has a split line or is in a triangle or quadrangle shape, and it is necessary to determine the orientation prior to printing, the orientation of the tablet T may be detected as well as the position.

When it is determined that the tablet is stored in an inappropriate position and printing is not possible, the tablet T is passed through under the first printing unit 3 without printing thereon. On the other hand, if it is determined that the tablet is stored in an appropriate position and printing is possible, the tablet T is conveyed as it is to below the print head H by the conveyor belt 13.

The print head H performs printing on the upper surface of the tablet T conveyed. When the printing is completed, the tablet T is then conveyed to below the printing state checking device 33.

The printing state checking device 33 photographs the tablet T conveyed, and sends the captured image to the control unit 5. The control unit 5 determines whether the printing state is acceptable or not based on the information sent from the printing state checking device 33.

Thereafter, the tablet T is reversed by the second pulley 12 and moved from the upper side to the lower side of the first conveyor 1 while being stored in the recess 131 of the conveyor belt 13.

The drying device 16 located where the conveyor belt 13 moves leftward in FIG. 1 from the second pulley 12 to the first pulley 11 (between c and d in FIG. 1) dries the ink adhering to one side of the tablet T reversed. The tablet with the ink dried is transferred from the first conveyor 1 to the second conveyor 2.

In the second conveyor 2, printing is performed on the unprinted side of the tablet T. The printing is performed in the same manner as described above. After the position of the tablet is checked by the position detector 42 and printing is performed by the print head H, the printing state is determined based on the information from the printing state checking device 43.

In the lower horizontal region of the conveyor belt 23, the drying device 25 dries the ink on the tablet T after printing. In this case, one side of the tablet T printed by the second printing unit 4 is oriented to face the drying device 25, and the process of drying the ink is performed during the conveyor belt 23 moves from the second pulley 22 to the first pulley 21.

The tablet T dried is stored and collected in the collection box 26 or 27. When the control unit 5 determines that printing has been properly performed on the tablet T based on the check result from the printing state checking device 33 and the printing stat; checking device 43, the tablet T is stored in the non-defective product collection box 26. On the other hand, when the control unit 5 determines that the printing is inappropriate, the tablet T is collected in the defective product collection box 27.

Thus, the printing process for the tablet T ends.

(Suction Chamber)

Next, the configuration of the conveyor C, particularly the configuration of the suction chambers 14 and 24 will be described in detail with reference to FIGS. 3 and 4. The suction chambers 14 and 24 have the same configuration, and therefore, the suction chamber 14 provided in the first conveyor 1 will be described below as an example.

In the first embodiment, a suction force adjusting device and a suction force adjusting method are formed by parts related to the suction, a suction method, and the like described below.

Figure 4:
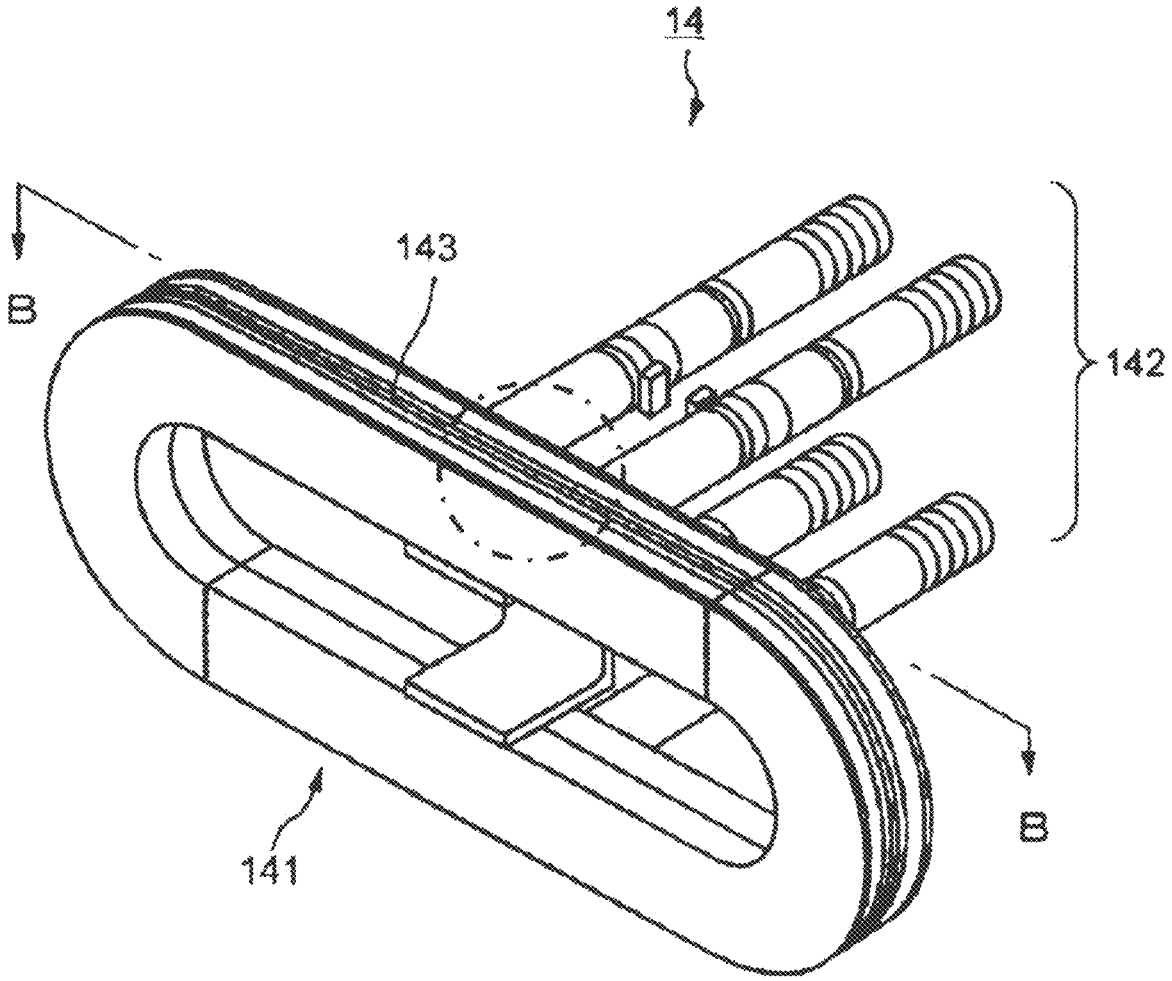
FIG. 4 is a perspective view illustrating the overall configuration of a suction chamber according to the first embodiment.

FIG. 4 is a perspective view illustrating the overall configuration of the suction chamber 14 according to the first embodiment. In FIG. 4, the suction chamber 14 is illustrated in substantially the same orientation as in the perspective view of FIG. 2 illustrating the overall configuration of the first conveyor 1. That is, although not illustrated in FIG. 4, the first pulley 11 is arranged on the left rear side in FIG. 4, and the second pulley 12 is arranged on the right front side in FIG. 4.

As illustrated in FIG. 4, the suction chamber 14 includes a chamber body 141 and a suction path 142 which is connected to a pump (not illustrated) and performs suction. The chamber body 141 is connected to a pump through the suction path 142.

As illustrated in FIGS. 3 and 4, the chamber body 141 is provided with a suction groove 143, which is a sucking portion for sucking air, over its entire outer circumference. The suction groove 143 is located immediately below the suction hole 132 of the conveyor belt 13 wrapped around the first pulley 11 and the second pulley 12. Therefore, when air is sucked from the chamber body 141 through the suction path 142, air is sucked from the suction groove 143, the recess 131 and the suction hole 132 of the conveyor belt 13. As a result, a suction force is applied (exerted) to the tablet T in contact with the recess 131, i.e., it acts on the tablet T.

In this manner, the suction chamber 14 applies a suction force to the tablet T stored in the recess 131 of the conveyor belt 13 through the suction hole 132 of the conveyor belt 13 to suck and hold the tablet T. Accordingly, the suction chamber 14 is configured to be capable of applying a suction force to the suction portions 130 over the entire circumference of the conveyor belt 13.

Although the suction force can be applied to the suction portions 130 over the entire circumference of the conveyor belt 13 by the suction chamber 14, it need not necessarily be applied to the entire circumference. That is, there may a portion where the suction force is not applied, or a portion to which the suction force is applied may be selectively set. Alternatively, the suction force may be changed with respect to each region of the entire circumference.

In addition, although a pump is mentioned above, for example, the suction chamber 14 may be connected to plurality of pumps through the suction path 142. The individual pumps can apply a plurality of suction forces to the suction holes 132 formed over the entire circumference of the conveyor belt 13 in a divided area as described below. Thus, the tablets T can be sucked and held by a desired suction force applied to each of the tablets T that are sucked, held and conveyed on the conveyor belt 13, according to its conveyance position on the conveyor belt 13.

Figure 5:
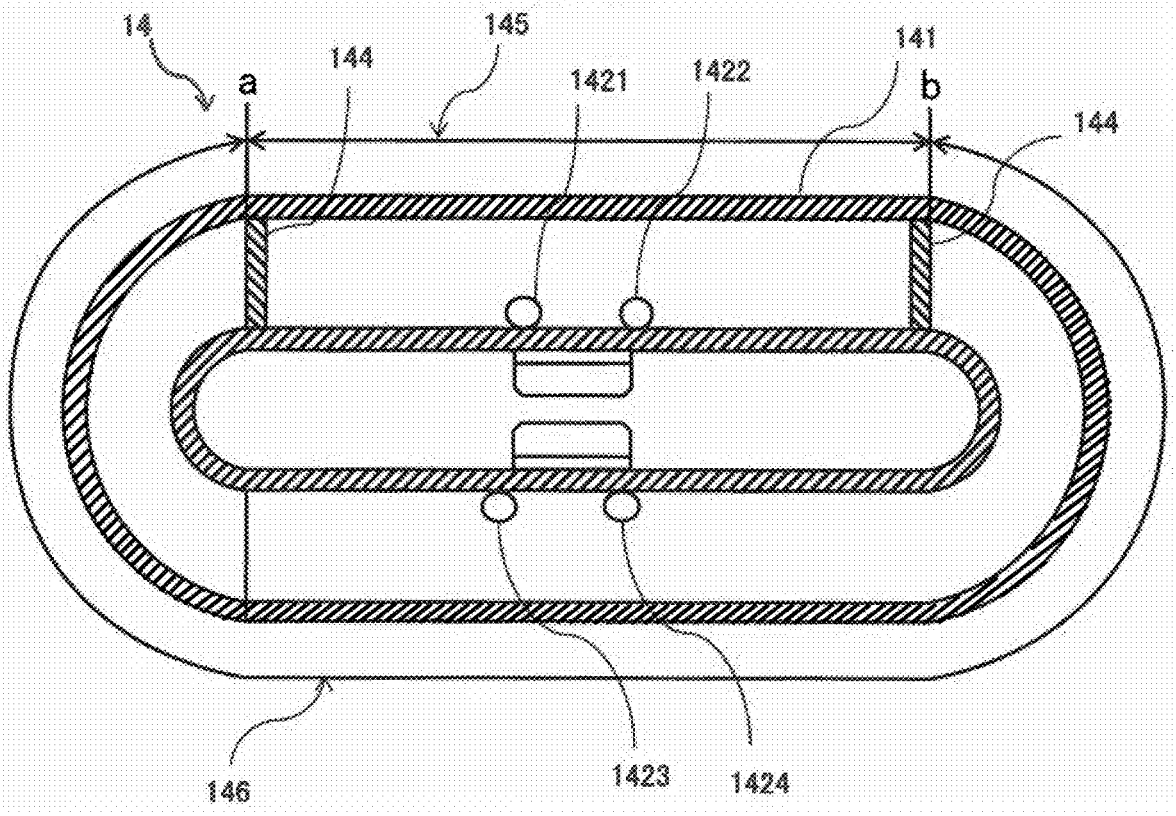
FIG. 5 is a cross-sectional view of the suction chamber taken along the line B-B in FIG. 4 in the tablet printing apparatus of the first embodiment.

FIG. 5 is a cross-sectional view of the suction chamber 14 of the first embodiment taken along the line B-B in FIG. 4. As illustrated in FIG. 5, partition walls 144, 144 are formed in two places inside the chamber body 141 of the suction chamber 14, and the inside of the chamber body 141 is divided into two sections.

As illustrated in FIG. 5, the partition wall 144 is formed at the position of reference letter a and the position of reference letter b indicated in FIG. 1. That is, the inside of the chamber body 141 is divided by the partition walls 144, 144 into a first section 145 defined between the position of reference letter a and the position of reference letter b in FIG. 1, and a second section 146. Suction paths 1421 and 1422 are connected to the first section 145. Suction paths 1423 and 1424 are connected to the second section 146.

In this manner, the two sections 145 and 146 are partitioned by the partition walls 144, 144, and the suction paths 142 (1421 to 1424) are individually provided. Thus, air is not intercommunicated therebetween. With this, air can be sucked by a different suction force (suction pressure, air suction amount, air suction speed) for each section.

Accordingly, the tablet T conveyed as being stored in the recess 131 of the conveyor belt 13 sucked and held in the recess 131 by the suction chamber 14 sucking air through the suction hole 132. That is, the tablet T is sucked and held in the suction portion 130 of the conveyor belt 13 by a suction force applied by the suction chamber 14.

At this time, the suction hole 132 may be blocked by the tablet T sucked and held or may be not blocked. Depending on the size and shape of the tablet T sucked and held or its posture in the recess 131, the tablet T may not completely close the suction hole 132 in some cases. If the tablet T cannot close the suction hole 132, a space through which air is sucked from the suction hole 132 toward the suction chamber 14 is created in the vicinity of the contact position between the suction hole 132 and the tablet T. In such a case, as the tablet T is sucked and held through the suction hole 132, the air around the tablet T is sucked through the upper side and sides of the tablets T, and the suction hole 132.

In particular, when the suction chamber 14 applies a strong suction force, the amount of air sucked is increased, and the flow velocity of the air sucked is increased. This may result in a strong airflow generated around the tablet T, a larger reach range of the airflow, and the turbulence of the airflow.

The printing unit P of the tablet printing apparatus S includes an inkjet print head H. In the inkjet system, ink is ejected from the print head H toward the tablet T to be printed and deposited on the surface of the tablet T, and thereby printing is performed. The ink is in a state of flying between the print head H and the tablet T in a period from when it is ejected from the print head H until it is deposited on the surface of the tablet T.

At this time, when an airflow is generated in a space between the print head H and the tablet T, the shape of the ink ejected from the print head H and flying is deformed by the airflow, or the flying direction is affected by the airflow and the deposit position is displaced. As a result, printing defects occur, and the printing quality is degraded. It is allowable as long as the airflow does no, affect the print quality. However, in the case of strong airflow, large airflow reach range, turbulent airflow, or the like, the print quality is degraded largely. Further, when the influence of the airflow reaches the vicinity of the nozzle of the print head H for ejecting ink, the ink around the nozzle is dried. This causes ejection defects, and likewise leads to degradation in the printing quality. There may also be a case where the ink, which has not been deposited on the tablet T, scatters like mist. If the ink scatters like mist, for example, it is sucked together with the air sucked by the suction chamber 14, and adheres to the side surface of the tablet T being conveyed or the like.

Therefore, in the tablet printing apparatus S of the first embodiment, the suction force applied to the tablet T is reduced at the time of printing to thereby reduce the amount of air sucked and the flow velocity such that the occurrence of printing defects can be minimized as much as possible. That is, at least, when the tablet T passes through under the print head H for printing, the suction force applied to the tablet. T is reduced to be lower than that applied to the tablets T at other positions on the conveyor belt 13.

The suction force may be reduced not only when the tablet T passes through under the print head H. For example, the suction force may be reduced after the tablet T is supplied to the conveyor belt 13 at the upstream of the print head H until the tablet T passes through under the print head H. Further, the suction force may be reduced from before the tablet T passes through the position detector 32 for checking the state of the tablet T suctioned by the suction portion 130 (from a predetermined conveyance position before the tablet T passes through the position detector 32) after the tablet T is supplied to the conveyor belt 13. This is because the position detector 32 detects the position, posture, and the like of the tablet T to be printed as described above, it is required to detect the position of the tablet T in the same state as in the printing process, i.e., in a state where the tablet T is sucked with a reduced suction force. As will be described later, when there is a change in the suction force during the conveyance of the tablet T, and if the change is large, the tablet T may shift or shake, resulting in a change in the position and posture thereof. If the position and posture of the tablet. T changes due to such a large change in the suction force after the position detector 32 detects the position and posture of the tablet T until the end of the printing process, printing may not be performed appropriately. Therefore, during the period from the detection of the position, posture, and the like of the tablet T by the position detector 32 until the end of the printing process, it is preferable not to change the suction force significantly such that the position and posture of the tablet T detected do not change before the printing process. Therefore, the position and posture of the tablet T are detected in a state where the suction force applied to the tablet T is reduced in the same manner as in the printing process.

In region where the tablet T is conveyed by the conveyor belt 13, a region where the tablet T is sucked and held on the conveyor belt 13 with a reduced suction force is hereinafter referred to as "first region" for the sake of convenience. Therefore, according to the above example, the first region corresponds to a region before the tablet T passes through the position detector 32 for checking the state of the tablet T suctioned by the suction portion 130 after the tablet T is supplied to the conveyor belt 13 at the upstream of the print head H until the tablet T passes through under the print head H. Namely, the first region is included between the reference letters a and b in FIG. 1. Therefore, in the first embodiment, the position facing the print head H" indicates not only directly below the print head H, but also includes around directly below the print head H.

Incidentally, the suction chamber 14 applies a suction force to the suction portions 130 over the entire circumference of the conveyor belt 13. In the region other than the first region, it is not necessary to consider the influence on the flying ink at the time of printing. Therefore, it is not necessary to reduce the suction force, and the suction force may be set more than that against the self-weight of tablet T and the centrifugal force generated during the conveyance as described below. Of the entire circumference of the conveyor belt 13, a region other than the first region is referred to as "second region" for the sake of convenience. That is, the second region includes positions in front of and behind the position facing the print head H. In the first embodiment, the positions in front of and behind the position facing the print head H indicates a position on the upstream side (in front) and a position on the downstream side (behind) in the conveyance direction of the tablet T with respect to the position facing the print head H.

The first region corresponds to the first section 145 in the suction chamber 14. On the other hand, the second region corresponds to the second section 146 in the suction chamber 14. Since each section is independently provided with the suction path 142, the suction force applied to the tablet T in the first section 145 can be set to be weaker than that applied to the tablet T in the second section 146.

As described above, according to the first embodiment, the suction chamber 14 can be adjusted to apply a weaker suction force in the first section 145 corresponding to the first region as compared to in the second section 146 corresponding to the second region. Thus, it is possible to reduce the suction force applied to the tablet passing under the print head H for printing. By controlling the suction chamber 14 in this manner, a suction force necessary for each process performed in the tablet printing apparatus S can be applied to the tablet T.

In particular, a reduced suction force is applied to the tablet T passing under the print head H as compared to those in the other region (the second region) conveyed on the conveyor belt 13. Thereby, an airflow that degrades the printing quality can be prevented from occurring around the tablet T or in a space between the tablet T and the print head H. This prevents cases where the shape of the ink ejected from the print head H and flying is deformed by the airflow, or the flying direction is affected by the airflow and the deposit position is displaced, which leads to printing defects, resulting in the degradation of the printing quality. This also prevents cases where the influence of the airflow reaches the vicinity of the nozzle of the print head H for ejecting ink and the ink around the nozzle is dried, which causes ejection defects, resulting in the degradation of the printing quality. Besides, it is possible to prevent the ink, which has not been deposited on the tablet T, from scattering like mist and adhering the side surface of the tablet T being conveyed.

In the second region, it is required to apply a suction force sufficient to prevent the dropping of the tablet T from the conveyor belt 13. This suction force is much stronger than that just enough to prevent the tablet T from shifting. Therefore, in the tablet printing apparatus S and the tablet printing method provided, the suction of air for sucking and holding tablets is properly controlled to secure the stable ejection of ink, and thereby the printing quality can be maintained.

Modification

In the above description, it is assumed that the inside of the suction chamber 14 is divided into two sections (145, 146) to apply two types of suction forces. However, the suction force applied to the tablet T is not limited to two types, and it may be controlled with respect to each process performed in the tablet printing apparatus S. In this case, two or more types of suction force are appropriately applied to the tablets T.

For example, as described above, it is required to apply a suction force to the tablets T sucked and held on the conveyor belt 13 for reliably holding them in any of the following regions: an upper region where printing is performed between the first pulley 11 and the second pulley 12 of the first conveyor 1 (between reference letters a and b in FIG. 1), a lower region toward the second conveyor 2 (between reference letters c and d in FIG. 1), and a region therebetween that rotates in the circumferential direction by the second pulley 12 (between reference letters b and c in FIG. 1). Specifically, a suction force, which prevents the tablet T from shifting or shaking along with the conveyance, is required in the upper region, suction force, which prevents the tablet T from falling, is required in the lower region, and a suction force against the centrifugal force is required in the region that rotates in the circumferential direction by the second pulley 12. Further, in the vicinity of where printing is performed in the upper region, the suction force is set so as not to affect the printing process.

Therefore, for example, the inside of the chamber body 141 may be divided into a plurality of sections to apply different suction forces. That is, the suction chamber 14 is configured to apply a suction force for preventing the tablet T from falling in its lower section, and a suction force for holding the tablet T against the centrifugal force in the section where the tablet T moves in the circumferential direction by the second pulley 12. Thereby, the tablet T can be sucked and held more appropriately on the first conveyor 1. In the lower region and the part of the second pulley 12, the required suction force is considerably larger than the suction force in the upper section, which prevents the tablet T from shifting and shaking as it is conveyed and also does not affect the printing process. Nevertheless, the optimal suction force can be appropriately applied to the tablet T in each process (in each position of the tablet T being conveyed). This applies to the second conveyor 2.

In other words, the region on the upper side of the suction chamber 14 where the suction force is weakened is the first region, and other regions on the lower side of the suction chamber 14 and around the second pulley 12 correspond to the second region. The suction force can be different between the lower region of the suction chamber 14 and the region around the second pulley 12; however, the suction force is set to be stronger than that in the upper region.

As described above, even in the state where an airflow is generated around the tablet T on the conveyor belt 13 due to suction, the suction force for reliably sucking and holding the tablet T at any position on the conveyor belt 13 is reduced so as not to generate an airflow that causes printing defects at the time of printing. Since the printing is performed in the upper region between the first pulley 11 and the second pulley 12 of the first conveyor 1, the tablet T is supported by the conveyor belt 13. Therefore, even if the suction force is reduced as compared to the other regions, it does not affect the conveyance.

Figure 6:
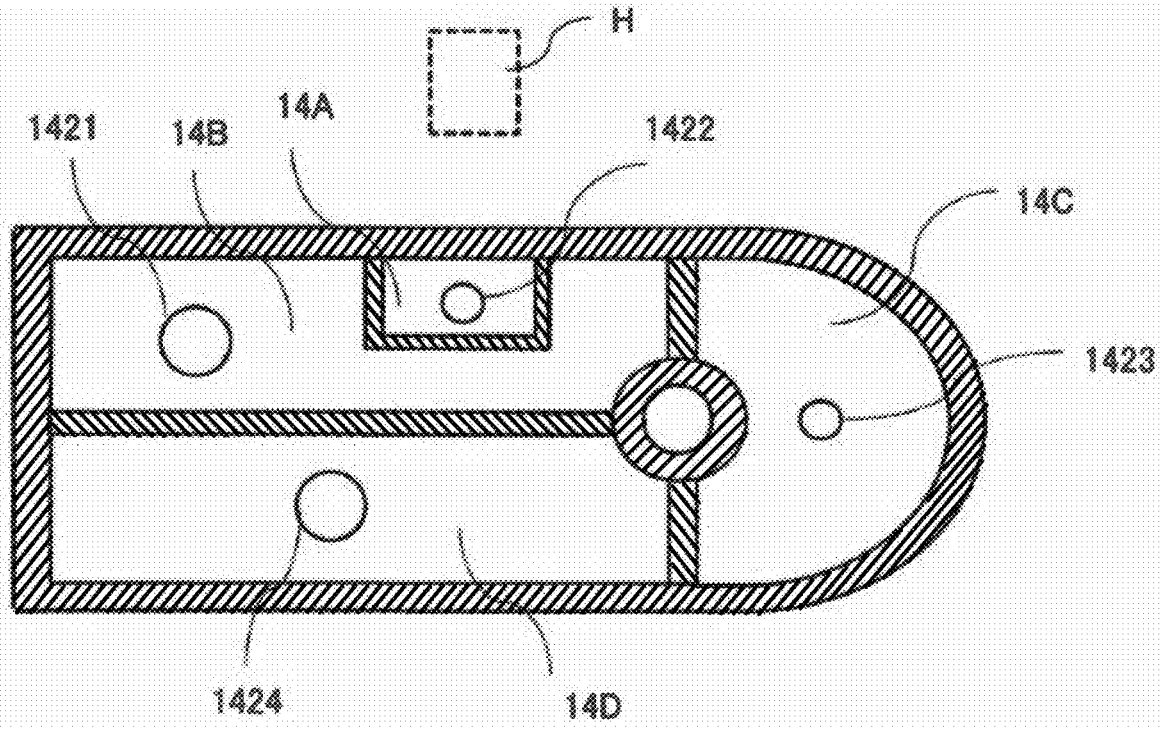
FIG. 6 is a view illustrating a part of another configuration of the suction chamber according to the first embodiment.

Further, for example, as illustrated in FIG. 6, sections may be further provided in the upper portion of the suction chamber 14. For example, there may be provided a section 14A in the part where printing is performed, the suction force of the section 14A is set so as not to affect the printing process. The suction force of a section 145 located around the section 14A in the upper portion is set so as not to affect the conveyance. As described above, there may be provided a section 14C around the second pulley 12, and a section 14D in the lower portion of the suction chamber 14.

Besides, after having been transferred from the tablet supply device 15 to the first conveyor 1 or from the first conveyor 1 to the second conveyor 2, the tablet T shakes. If the tablet T is shaking, accurate position detection and printing cannot be performed. Therefore, it is preferable to apply a large suction force around where the tablet T is transferred in the receiving side. The larger the suction force is, the faster the shaking of the tablet T stops. In other words, a section may be further provided at the part where the tablet is transferred in the upper portion of the suction chamber 24 of the second conveyor 2 to apply a suction force for quickly stopping the shaking of the tablet T.

In this manner, it is possible to provide as many sections as necessary to appropriate parts. That is, the suction chamber 14 can be divided into the first region and the second region, the inside of the regions can be further sectionalized. Then, an appropriate suction force can be set for each section.

At the boundary between sections of different suction forces, there is a change in the suction force. If the change is large, the tablet T may shift, shake, or fall off from the belt. Therefore, a section may be provided for moderating the change in the suction force in front of and behind the sections for applying required suction forces. With this, the change of the suction force can be moderated over the sections. Thus, it is possible to prevent the tablet T from shifting, shaking, falling off the belt, and the like.

Second Embodiment

Next, a second embodiment, will be described with reference to FIGS. 7 to 14. In the second embodiment, like reference numerals designate like constituent elements as those described in the first embodiment, and the same description will not be repeated.

In the first embodiment described above, the suction force applied to the tablet T in the first region where printing is performed is lower than that applied to the tablet T in the second region, thereby preventing the occurrence of mist and printing defects due to an airflow caused by the suction of air in the suction portions 130.

On the other hand, in the second embodiment, in order to reduce the suction force applied to the tablet T in the first region without changing the suction force generated by the suction chamber 14, the following method is adopted. This method will be described in order with reference to FIGS. 7 and 8.

The suction force generated by the suction chamber 14, for example, is generated in the suction groove 143 arranged in the suction chamber 14 by discharging the air from the suction chamber 14, and is determined by discharge speed and amount. The suction force generated in the suction groove 143 acts on the tablet T through a conveyor belt 133 to pull the tablet T onto the conveyor belt 133. This pulling force becomes a suction force for the tablet T. In the second embodiment, the suction force acting on the tablet T on the conveyor belt 133 is reduced without changing the discharge speed and amount of air in the suction chamber 14.

Figure 7:
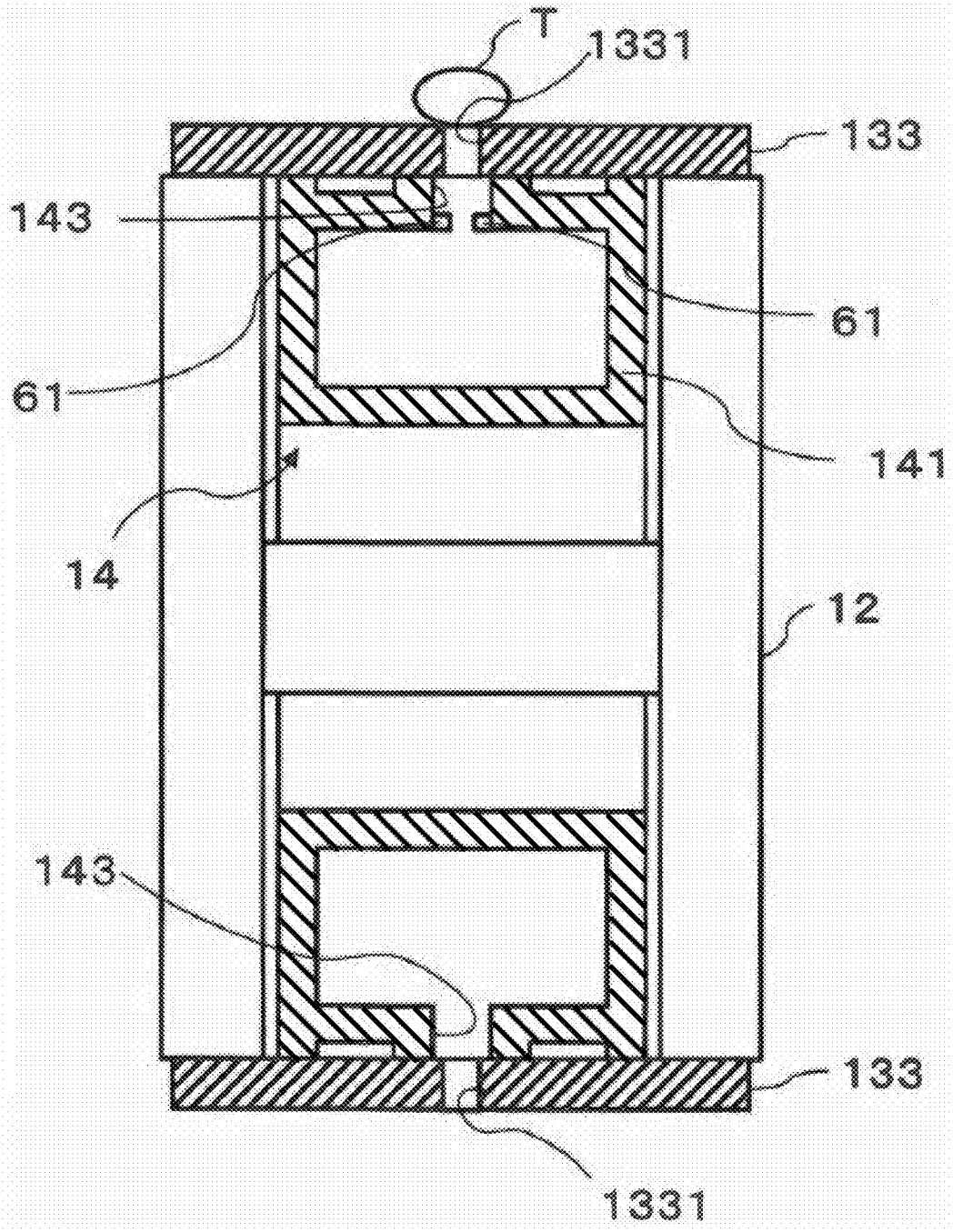
FIG. 7 is a cross-sectional view of a tablet printing apparatus taken along the line A-A in FIG. 1 in the tablet printing apparatus of a second embodiment.

FIG. 7 is a cross-sectional view of the tablet printing apparatus S taken along the line A-A in FIG. 1 in the tablet printing apparatus S of a first embodiment. Incidentally, the left side in FIG. 7 corresponds to the front side of the first conveyor 1 illustrated in FIG. 1. In FIG. 7, the second pulley 12 is illustrated without being sectioned.

In FIG. 7, the upper side across the rotation axis of the second pulley 12 indicates a position where the conveyor belt 133 comes in contact with the second pulley 12 after the tablet T on the conveyor belt 133 is printed in the first printing unit 3 and passes under the printing state checking device 33, i.e., a portion denoted by reference letter b in FIG. 1. On the other hand, the lower side across the rotation axis of the second pulley 12 indicates a position where the drying device 16 located at a position facing the conveyor belt 133 starts the drying process as the conveyor belt 133 is separated from the second pulley 12 after the tablet T on the conveyor belt 133 is reversed along with the rotation of the second pulley 12, i.e., a portion denoted by reference letter in FIG. 1.

As illustrated in FIG. 7, the conveyor belt 133 includes a groove 1331 in a region opposite to the suction groove 143 formed in the suction chamber 14, and does not have the recess 131 differently from the conveyor belt 13 of the first embodiment. The left and right (in FIG. 7) of the groove 1331 are partly connected to each other to form a ladder shape. When the groove 1331 is formed around the circumference of the conveyor belt 133, as compared with the case where the recesses 131 are formed as in the conveyor belt 13 of the first embodiment, airflow due to suction tends to occur. This is because a suction air always flows around the tablet T from a portion of the groove 1331 where the tablet T is not sucked and held.

The suction groove 143 is provided with a suction force lowering member 61. The suction force lowering member 61 is a suction force adjusting device for lowering an airflow caused by suction. The suction force lowering member 61 is made of, for example, a flange-like member, and is arranged so as to close a part of the suction groove 143 at a boundary between the suction groove 143 of the suction chamber 14 and the chamber body 141. The suction force lowering member 61 is located at a position facing the conveyor belt 133 and is formed so as to overhang from both sides of the suction groove 143.

Figure 8:
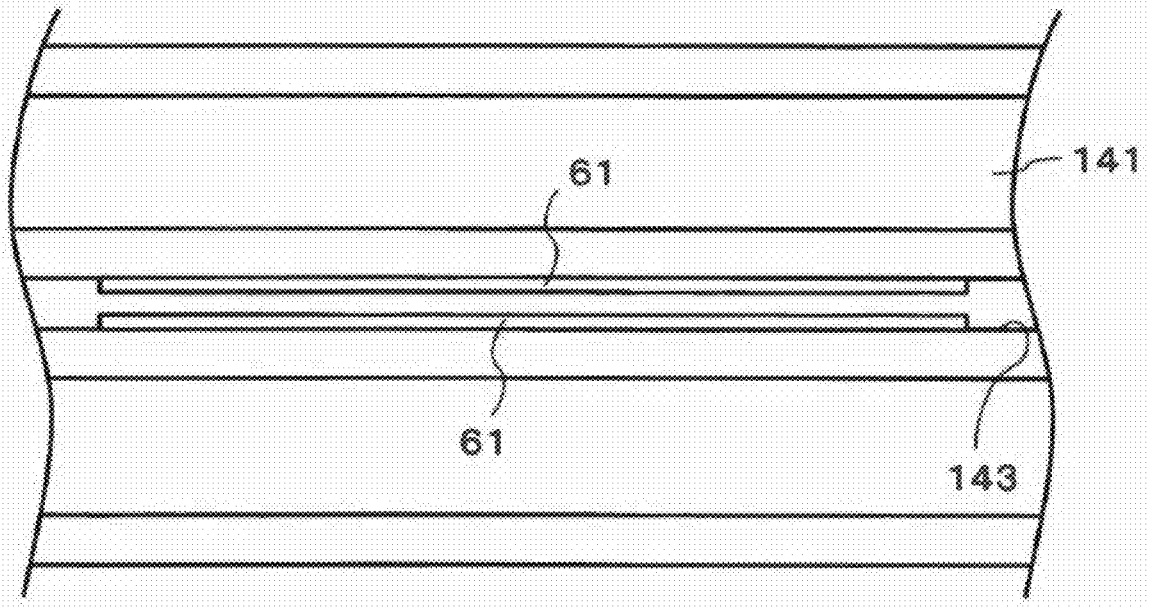
FIG. 8 is an enlarged plan view illustrating a suction force lowering member according to the second embodiment.

FIG. 8 is an enlarged plan view of the suction force lowering member 61 provided in the first region according to the second embodiment. FIG. 8 illustrates an enlarged view of a portion encircled by a dotted line in FIG. 4 illustrating the entire suction chamber 14.

In the enlarged view of FIG. 8, the suction groove 143 is illustrated in the center. In addition, the suction force lowering member 61 is provided so as to close a part of the suction groove 143. That is, the suction force lowering member 61 is formed in a range corresponding to the first region so as to overhang from both sides of the suction groove 143. For example, the suction force lowering member 61 is formed with the same width from both sides of the suction groove 143. With the suction force lowering member 61 formed in this manner, air is sucked from the center of the suction groove 143. Although the suction force for the tablet T decreases, the posture and the like of the tablet T are not disturbed in sucking and holding the tablet T.

As described above, according to the second embodiment, the suction force lowering member 61 is provided in the suction groove 14 of the suction chamber 14 to narrow the groove width (opening width) of the suction groove 143. This limits the amount of air that can pass through the suction groove 143 by the suction force of the suction chamber 14. As a result, the amount of air that pulls the tablet T is reduced. Thus, the suction force applied to the tablet T decreases.

Particularly, since the suction force lowering member 61 is located at a position corresponding to the first region, the suction force of that part decreases, and, as a suction force necessary for the tablet T, a weaker (reduced) suction force than that applied in the second region can be applied. Therefore, it is possible to prevent the generation of such an airflow around the tablet T that the sucked air affects the printing process. This prevents cases where the shape of the ink ejected from the print head H and flying is deformed by the airflow, or the flying direction is affected by the airflow and the deposit position is displaced, which leads to printing defects, resulting in the degradation of the printing quality. This also prevents cases where the influence of the airflow reaches the vicinity of the nozzle of the print head H for ejecting ink and the ink around the nozzle, is dried, which causes ejection defects, resulting in the degradation of the printing quality. Besides, it is possible to prevent the ink, which has not been deposited on the tablet T, from scattering like mist and adhering to the side surface of the tablet T being conveyed.

Incidentally, the suction force lowering member 61 may be arranged in any position as long as it is located in the suction groove 143 and can avoid contact with the conveyor belt 133. The suction force lowering member 61 need not necessarily be located in the suction groove 143 itself, and may be arranged wherever it can limit the amount of air that can pass through the conveyor belt 133 so as to reduce the suction force acting on the tablet T through the conveyor belt 133. Alternatively, another member may be provided.

As described above, the suction force generated by the suction chamber 14 can be controlled by the amount of the overhang of the suction force lowering member 61 from both sides of the suction groove 143. Therefore, the size of the suction force lowering member 61 is determined according to the type of the suction force to be applied to the tablet T in the first region.

On the other hand, the lower side across the rotation axis of the second pulley 12 corresponds to the second region, i.e., the second section 146 in the suction chamber 14, and there is no need to reduce the suction force to be applied. Therefore, the suction force lowering member 61 for closing a part of the suction groove 143 is not provided at the boundary between the suction groove 143 and the chamber body 141, which corresponds to the second section 146. Incidentally, the suction force in the suction chamber 14, the groove width of the suction groove 143, and the like are appropriately determined such that a suction force, which ensures the holding of the tablet T being conveyed, can be applied to the tablet T.

Modification

The suction force lowering member 61 arranged in the boundary between the suction groove 143 and the chamber body 141 has been described above with reference to FIGS. 7 and 8. Although the suction force lowering member 61 is a flange-like member, it is also possible to use another member capable of achieving the same effects as those of the suction force lowering member 61. The type of the suction force to be applied to the tablet T can be freely set depending on the size, shape, number and the like of openings formed in a plate-like member as the suction force lowering member 61.

Figure 9:
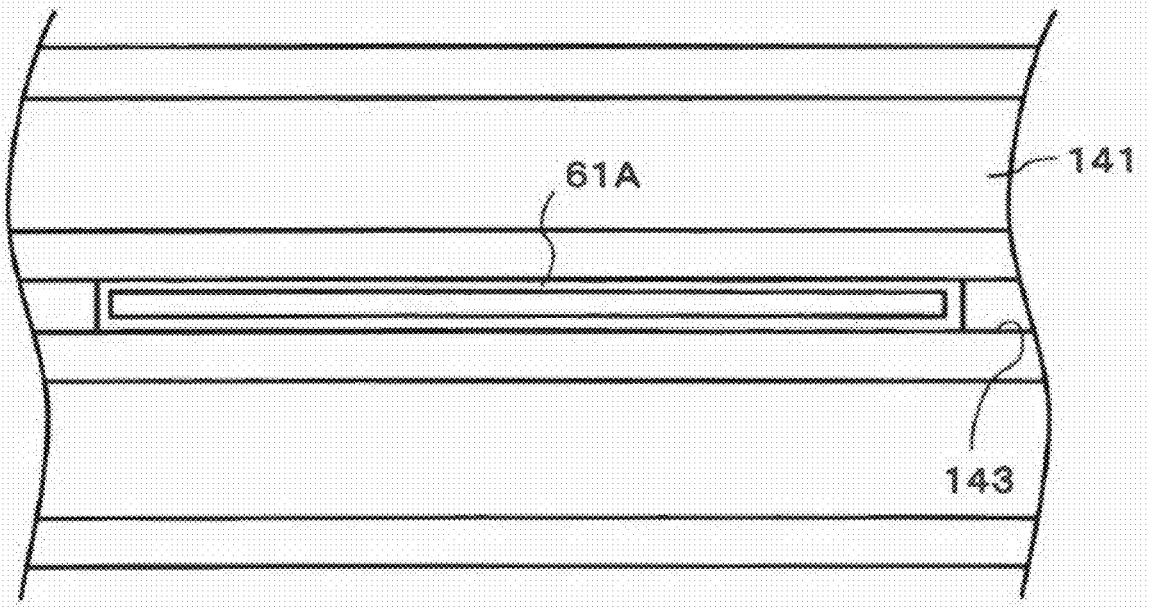
FIG. 9 is an enlarged plan view illustrating another example of the suction force lowering member according to the second embodiment.

For example, as can be seen in FIG. 9 illustrating a modification of the suction force adjusting device, the use of a suction force lowering member 61A having a hollow rectangular pillar shape (rectangular frame shape) is also effective. The use of the frame-like suction force lowering member 61A can eliminate the influence of the airflow coming from the upstream side and the downstream side in the conveyance direction of the tablet T in the suction force lowering member 61A (the influence of the suction airflow on the upstream side and the downstream side). Thus, the influence of the airflow can be more reliably suppressed. That is, it is possible to more reliably adjust the amount of air that can pass through the suction force lowering member 61A. Thereby, the suction force acting on the tablet T can be adjusted.

Figure 10:
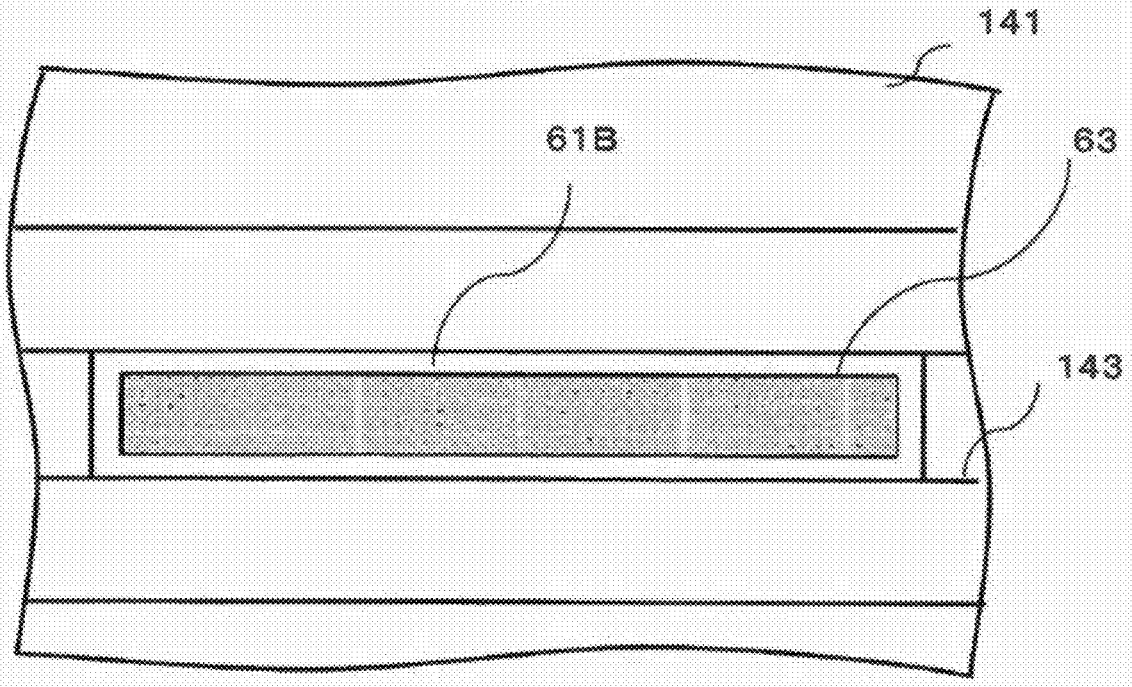
FIG. 10 is an enlarged plan view illustrating another example of the suction force lowering member according to the second embodiment.

As illustrated in FIG. 10, a porous member 63 may be arranged in an opening formed in a frame-like suction force lowering member 61B to reduce the suction force. When the porous member 63 is used in this manner, a uniform pressure loss (pressure resistance) is obtained, resulting in less variation in the suction force. Moreover, it is possible to prevent dust or the like from entering the suction chamber 14 by the function of a filter. Further, when it is desired to change the suction force gradually along the conveyance direction of the tablet T as will be described later, it can be easily realized by gradually changing the opening ratio of the pores.

Figure 11:
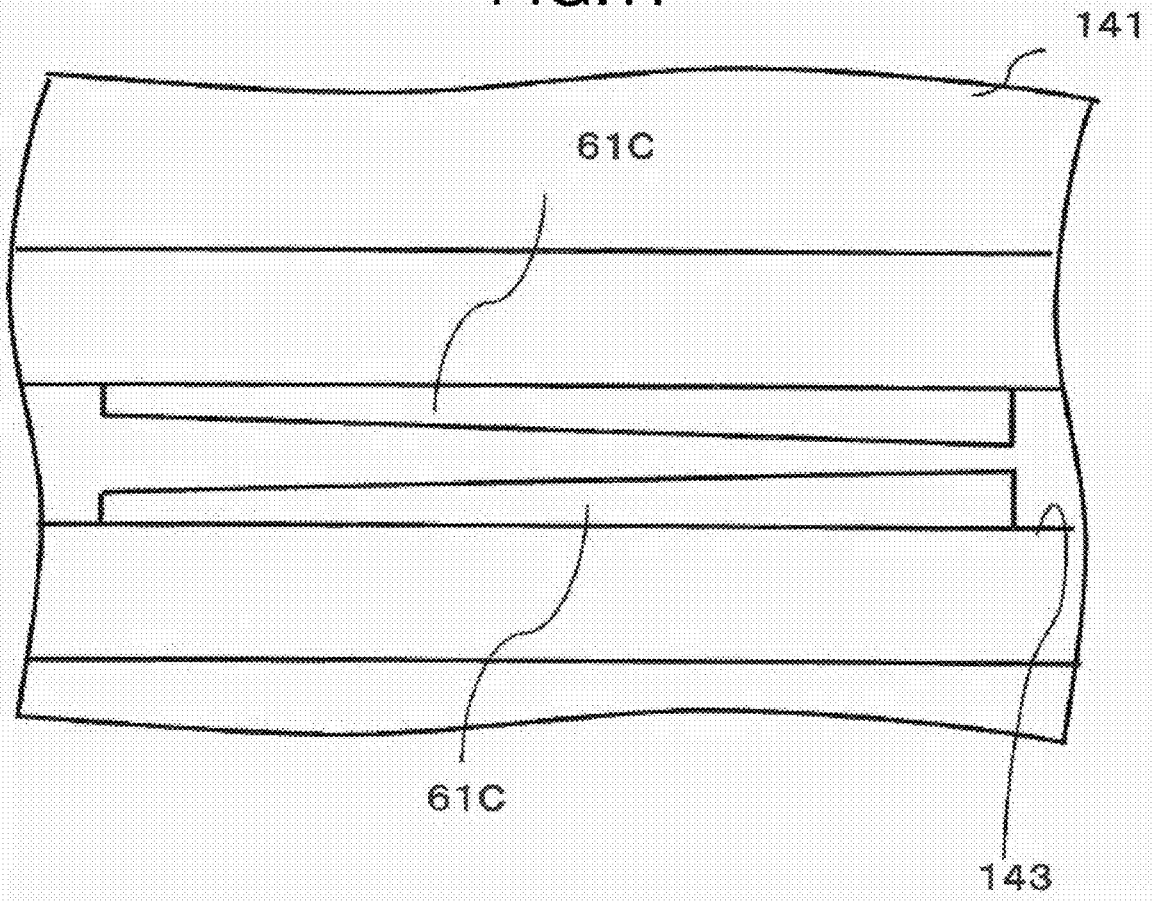
FIG. 11 is an enlarged plan view illustrating another example of the suction force lowering member according to the second embodiment.

As illustrated in FIG. 11, the use of a wedge-shaped flange portion 61C as the suction force lowering member enables the opening of the suction groove 143, i.e., a suction port, to be gradually narrowed. This moderates the change in the suction force in the conveyance direction of the tablet T, and the influence of the airflow can be suppressed.

Figure 12:
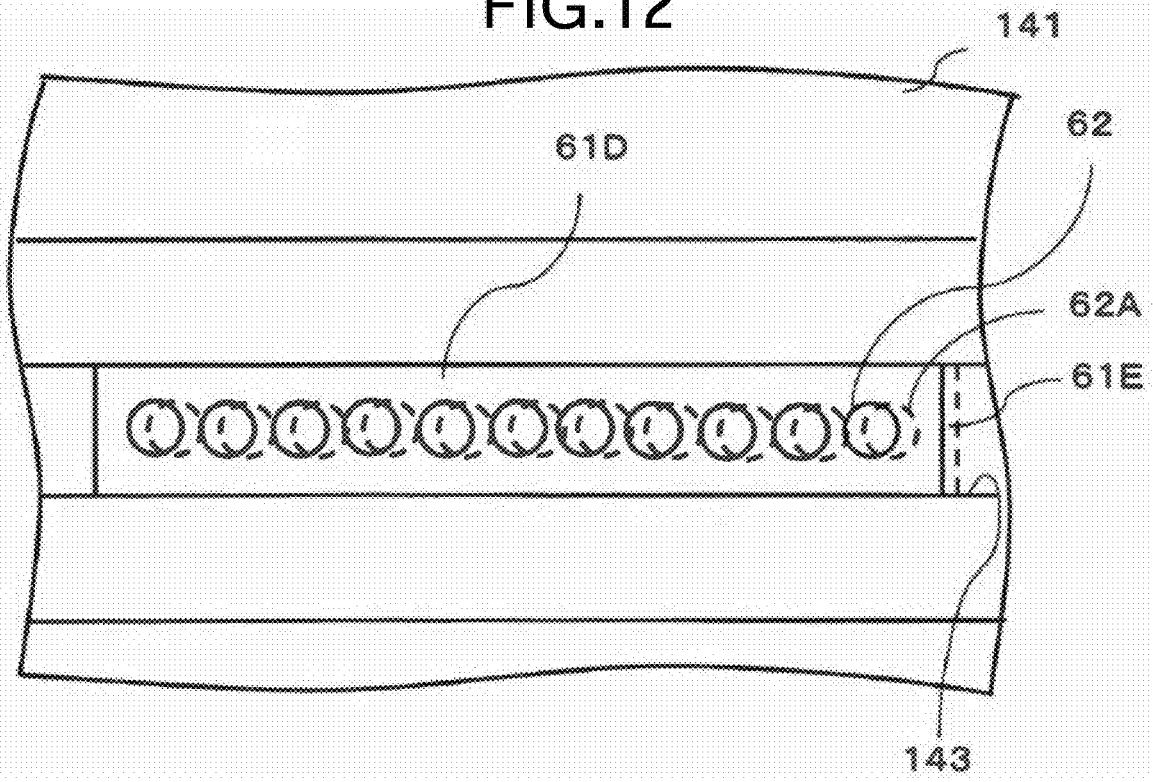
FIG. 12 is an enlarged plan view illustrating another example of the suction force lowering member according to the second embodiment.

As illustrated in FIG. 12, a punching board 61D which is a plate-like member having an opening 32 formed therein may be used as the suction force lowering member. Since the flow rate of the air sucked by the opening 62 is limited, the suction force is reduced as compared with the case where the punching board 61D is not provided. By arranging the punching board 61D having the opening 62 in the suction groove 143, it is possible to avoid breakage of the punching board 61D itself or breakage of the conveyor belt 133 due to contact between the punching board 61D and the conveyor belt 133, and the like.

Further, as indicated by a dotted line in FIG. 12, another punching board 61E may be provided such that it overlaps and is sifted relative to the punching board 61D. With this, the size of the opening and the opening ratio can be changed, thereby enabling fine adjustment of the suction force.

Figure 13:
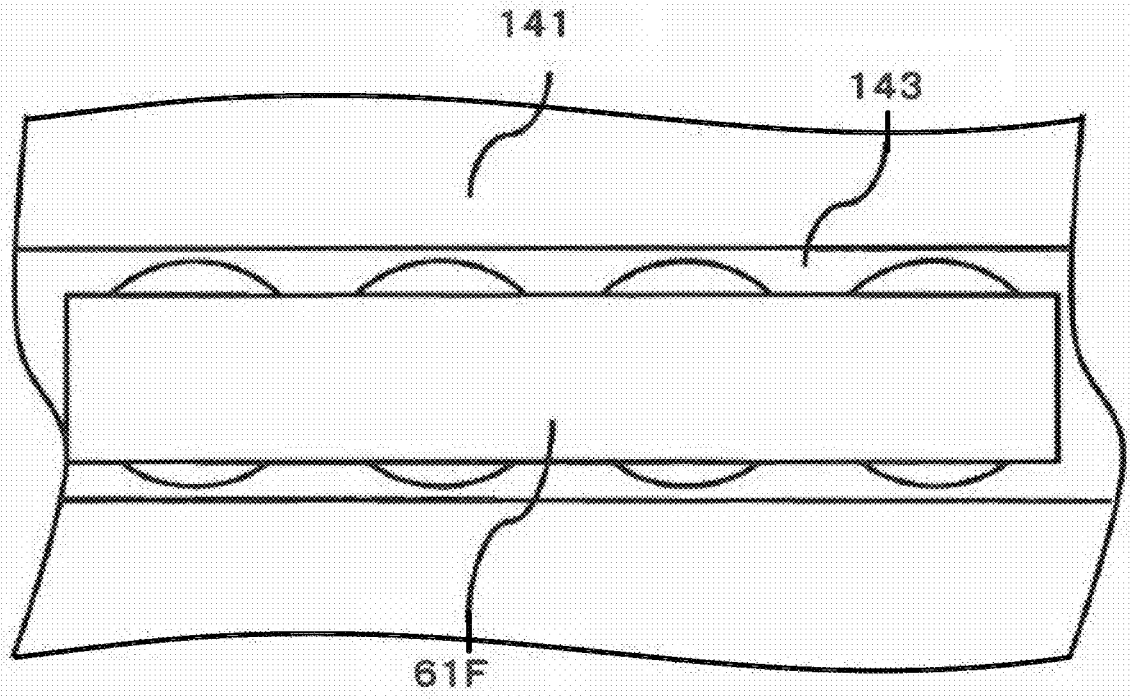
FIG. 13 is an enlarged plan view illustrating another example of the suction force lowering member according to the second embodiment.

Further, as illustrated in FIG. 13, a plate-like member 61F may be provided as the suction force lowering member so as to cover the suction groove 143 formed of a series of suction holes. The plate-like member 61F may be the punching board 61D or the porous member 63 described above, or may be a net member described later.

The flat plate-like member 61F is formed to have a narrower width than that of the suction groove 143 formed of a series of suction holes (the diameter of the suction holes), and shields the opening of the suction groove 143. The tablet T is sucked by the suction force from part of the opening not closed by the plate-like member 61F. Thus, the suction force can be adjusted by appropriately determining the width of shielded portion of the opening.

Figure 14:
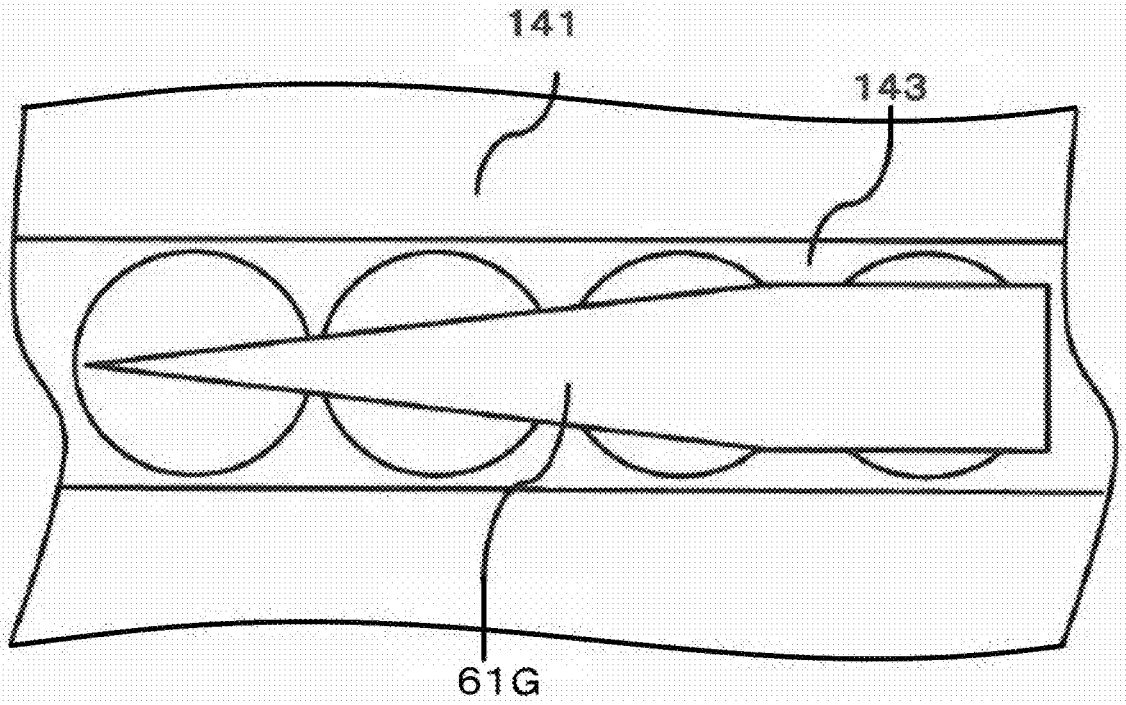
FIG. 14 is an enlarged plan view illustrating another example of the suction force lowering member according to the second embodiment.

In addition, as illustrated in FIG. 14, the area of the opening of the suction groove 143 to be shielded can be gradually changed by using a plate-like member 61G. With this, it is possible to moderate the change of the suction force depending on the location as described above. By providing portions shielded and not shielded by the plate-like member 61G, it is possible to prevent the tablet T from shifting, shaking, and falling off the belt due to an abrupt change of the suction force. In order to change the area to be shielded the shape of the plate-like member 61G is not limited to a triangle, and may be determined as appropriate.

As a other modification for example, a mesh member may be used as the suction force lowering member, i.e., a suction force adjusting device. In this case, for example, by adjusting the width of the mesh, the amount of air passing through the groove 1331 of the conveyor belt 133, i.e., the suction force, can be controlled. In other words, by providing the mesh member at the boundary between the chamber body 141 and the suction groove 143 corresponding to the first region, the suction force applied to the tablet T passing through the first region can be reduced.

Further, the aforementioned plate-like member and the mesh member may be arranged such that they overlap and are sifted each other. With this, the size and the opening ratio of openings, pores or the like of the plate-like member, or the size and the opening ratio of the mesh of the net can be changed to adjust the suction force applied to the tablet T passing through the first region.

Further, in the suction force lowering member 61A described above, closed range (enclosure) of the opening may be provided only on the downstream side in the conveyance direction of the tablet T (the frame may be eliminated only on the upstream side in the conveyance direction). This reduces the decrease in the suction force due to the influence of the airflow around the opening on the downstream side in the conveyance direction. Thus, the suction force can be gradually reduced from the upstream side in the conveyance direction. Thereby, it is possible to suppress the displacement of the tablet T or the like due to a sudden drop in the suction force.

The change of the suction force can be moderated not only by gradually narrowing the opening with the amount of the overhang from both sides of the suction groove 143, but also by gradually reducing the size of the mesh or the pores, by gradually widening the intervals, or gradually making the arrangement distribution sparse.

The conveyor belt 133 having the groove 1331 in a ladder shape in a plan view has been described as an example of the conveyor belt. However, the conveyor belt 13 having the recesses 131 described in the first embodiment may also be applicable. Those having various suction portions (described later) can also be applied.

As described above, the suction of air for sucking and holding the tablet T is suitably controlled by using the suction force lowering member (for example, 61, 61A to 61G) as a suction force adjusting device. Thereby, it is possible to provide a tablet printing apparatus S and a tablet printing method capable of ensuring stable ejection of ink and maintaining the printing quality.

Moreover, with the use of the suction force lowering member (for example, 61, 61A to 61G), the suction force applied to the tablet T at a desired position can be made appropriate without dividing the suction chamber 14 into a plurality of sections. Thus, the structure of the suction chamber 14 can be simplified. It is also possible to apply a plurality of suction forces to the tablets T without providing a plurality of suction sources. Further, when a strong suction force is applied to the tablet T, at the same time, the conveyor belt 13 is hardly sucked by the suction chamber 14. As a result, the contact force of the conveyor belt 13 with the suction chamber 14 becomes strong, which makes the conveyor belt 13 prone to wear. By partially reducing the suction force, a strong suction force is not applied to the entire conveyor belt 13. Thus, the wear of the conveyor belt 13 can be reduced, and the life of the conveyor belt 13 can be prolonged.

The suction force lowering member (for example, 61, 61A to 61G) may be detachably provided with the suction chamber 14. This facilitates the adjustment of the suction force or the adjustment of the position at which the suction force is reduced, and maintenance such as the removal of the suction force lowering member and the washing of it.

Although the suction force lowering member (for example, 61, 61A to 61G) has been described as being arranged in the suction groove 143 of the suction chamber 14, it is not so, limited. For example, all of a portion of the suction chamber 14 in contact with the conveyor belt 13 may be used for the suction force lowering member without providing the suction groove 143.

In addition, for example, as illustrated in FIG. 5, chamber portions may be formed correspondingly to the belt located on the upper side or the lower side of the first conveyor 1, or, as illustrated in FIG. 6, one chamber may be used. In both the cases, a necessary suction force can be set at each necessary portion by using the suction force lowering member (for example, 61, 61A to 61G).

Incidentally, irrespective of whether the suction force lowering member (for example, 61, 61A to 61G) or the section is used, if the suction force suddenly changes after printing, the tablet T may shift due to the change. As a result, the tablet T is out of the field of view of the camera for print checking, or the print checking takes long time (it finishes earlier when image processing is performed assuming that the posture of the tablet T does not change). Therefore, it is desirable that the change of the suction force be gradual not only on the upstream side in the conveyance direction but also on the downstream side.

Third Embodiment

Next, a third embodiment will be described with reference to FIGS. 15 to 17. In the third embodiment, like reference numerals designate like constituent elements as those described in the first embodiment or the second embodiment, and the same description will not be repeated.

In the first and second embodiments described above, the suction chamber 14 is divided into sections to reduce the suction force in a desired portion, or the suction force applied to the tablet T by the suction chamber 14 is reduced by limiting the airflow rate in a desired portion by using the suction force lowering member. On the other hand, in the third embodiment, a shielding member is provided to reduce the influence of the airflow generated around the tablet T when the suction chamber 14 sucks air.

Figure 15:
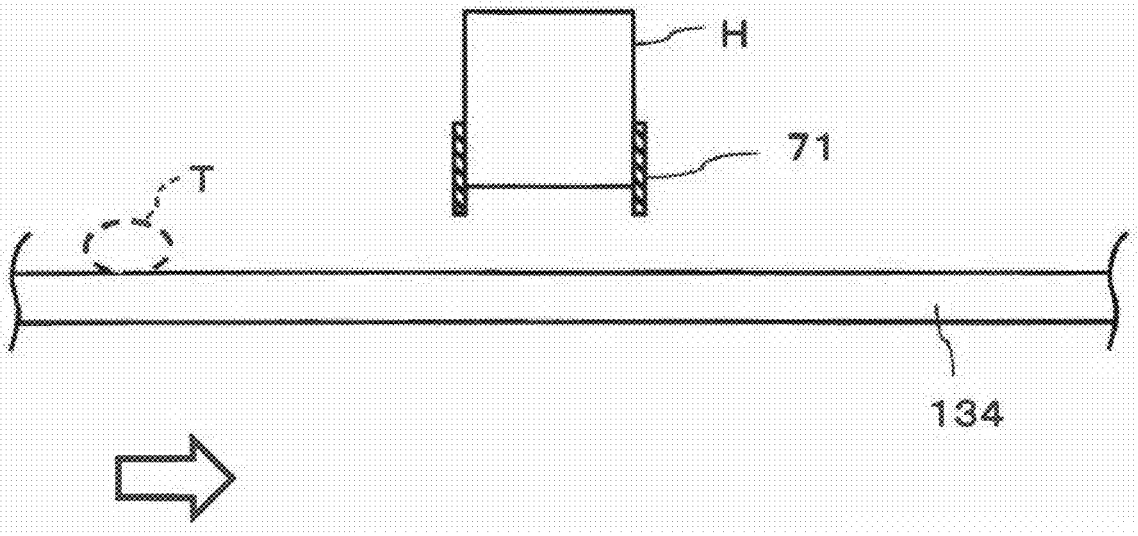
FIG. 15 is a cross-sectional view of the tablet printing apparatus as viewed from the front illustrating an enlarged view of an example of a shielding member according to a third embodiment.
Figure 16:
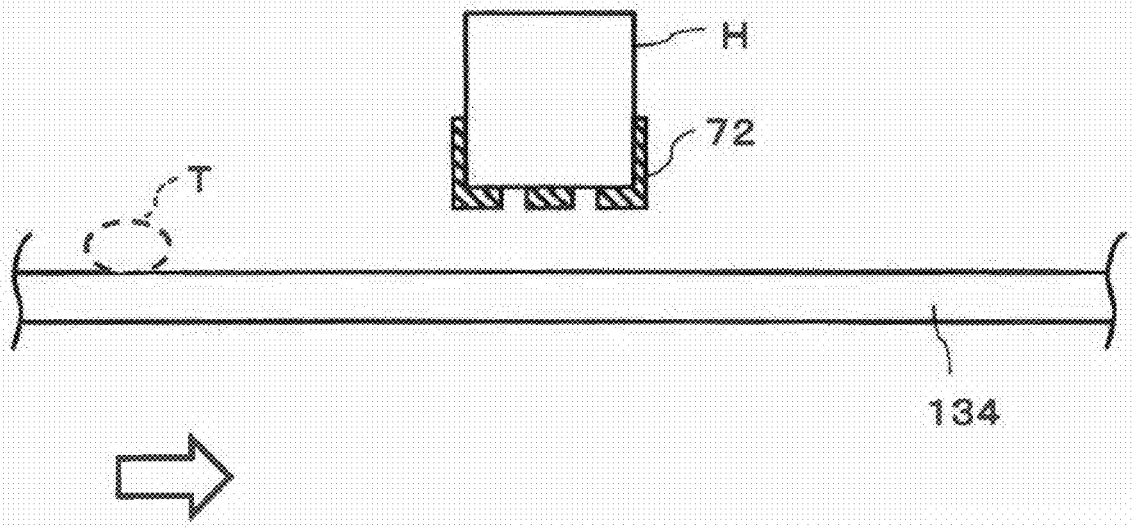
FIG. 16 is a cross-sectional view of the tablet Printing apparatus as viewed from the front illustrating an enlarged view of another example of the shielding member of the third embodiment.

FIGS. 15 and 16 are cross-sectional views of the tablet printing apparatus S as viewed from the front illustrating an enlarged view of an example of the shielding member according to the third embodiment. In FIGS. 15 and 16, the print head H is illustrated at the center, and a conveyor belt 134 is illustrated below it. Besides, the tablet T is indicated by a broken line on the conveyor belt 134, and is conveyed in the direction of the arrow. In FIGS. 15 and 16, the illustration of other configurations of the tablet printing apparatus S is omitted. The print head H has an array of or a plurality of arrays of ejection ports, and is formed in a rectangular parallelepiped shape with the arrangement direction of the ejection ports as its longitudinal direction.

As illustrated in FIG. 15, the print head H is positioned in a direction in which long sides thereof are perpendicular to the conveyance direction of the tablet T (the direction of the arrow in FIG. 15) in the horizontal plane. In other words, the long side direction of the print head H is parallel to the width direction of the conveyor belt 134.

A shielding member 71 is provided above the position where the tablet T enters under the print head H and also above the position where it exits from under the print head i.e., on both the upstream side and the downstream side of the print head H in the conveyance direction of the tablet T. The shielding member 71 is formed in, for example, a rectangular plate shape, and arranged such that its longitudinal direction extends along the long side direction of the print head H, and its lower end surface is located lower than the lower end surface (nozzle surface) of the print head H. The distance between the lower end of the shielding member 71 and the conveyor belt 134 is set such that the tablet T being printed can pass without contacting the shielding member 71 during the printing process. The shielding member 71 may be made of a material which does not damage the tablet T even if the tablet T comes into contact with the shielding member 71.

As described above, according to the third embodiment, the shielding member 71 is fixed as described above. Thus, even if the suction chamber 14 sucks air to suck and hold the tablet T, the air flowing from above the tablet T, i.e., from the print head H toward the suction portion 130 (see FIG. 2 or FIG. 3) can be rectified. Thereby, the influence of the airflow can be effectively prevented. This prevents cases where the shape of the ink ejected from the print head H and flying is deformed by the airflow, or the flying direction is affected by the airflow and the deposit position is displaced, which leads to printing defects, resulting in the degradation of the printing quality. This also prevents cases where the influence of the airflow reaches the vicinity of the nozzle of the print head H for ejecting ink and the ink around the nozzle is dried, which causes ejection defects, resulting in the degradation of the printing quality. Besides, it is possible to prevent the ink, which has not been deposited on the tablet T, from scattering like mist and adhering to the side surface of the tablet T being conveyed.

Further, the shielding member 71 is arranged on the print head H. Therefore, even if the posture of the tablet T conveyed is not appropriate, the posture is corrected as the tablet T comes in contact with the shielding member 71 before it enters under the print head H. Thus, at least, the tablet T is prevented from contacting the ejection port of the print head H. If the tablet T comes in contact with the ejection port, the ejection may not be performed properly.

FIG. 16 illustrates a modification of the shielding member 71 described above. The tablet T indicated by a broken line is placed on the conveyor belt 134 and is conveyed in the direction of the arrow toward the print head H in the same manner as the sectional view illustrated is FIG. 15.

As illustrated in FIG. 16, a shielding member 72 serves as a windshield similarly to the shielding member 71 illustrated in FIG. 15. The shielding member 72 extends to a position lower than the nozzle surface of the print head H such that the tablet T can pass thereunder. Thereby it is possible to reduce the influence of the airflow due to the suction of air by the suction chamber 14.

The shielding member 72 is arranged so as to cover the surface of the print head H facing the conveyor belt 134 except the nozzle for electing the ink, i.e., the ejection port surface excluding the ejection port. This is to prevent the tablet T from contacting each ejection port without blocking the ejection port. Therefore, with the configuration illustrated in FIG. 16, the shielding member 72 not only serves as a windshield, but it also protects the ejection port more reliably.

In either case of the shielding member 71 or 72, the airflow due to suction is less likely to hit the ejection port.

Thus, it is possible to prevent drying with the airflow due to suction when the ejection of the print head H is not performed.

There are also modifications different from the shielding members 71 and 72. An example has been described in which the shielding member 71 or 72 is provided to control the airflow flowing from the vicinity of the print head H to the suction portion 130 in one conveyor belt 134. In the following, the modifications of the shielding member will be described assuming that a plurality of conveyor belts for conveying the tablets T are arranged in parallel so as to form a plurality of lanes.

Figure 17:
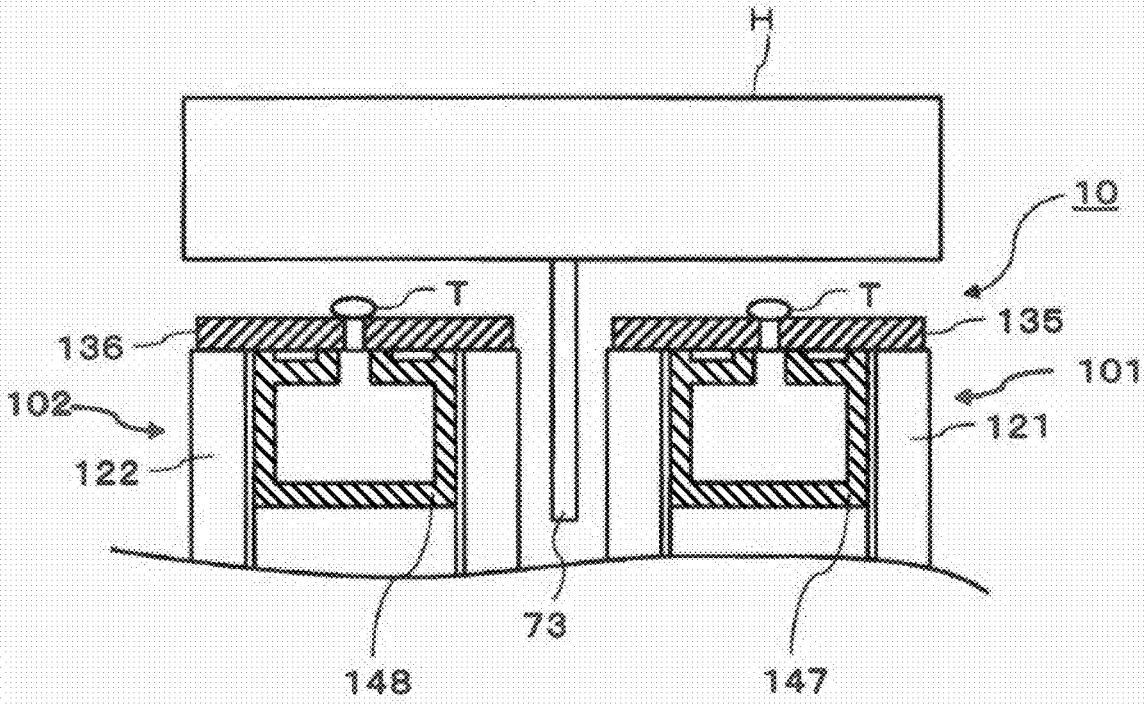
FIG. 17 is a cross-sectional view of the tablet printing apparatus as viewed from the right illustrating an enlarged view of another example of the shielding member of the third embodiment.

FIG. 17 is a cross-sectional view of the tablet printing apparatus S as viewed from the right illustrating an enlarged view of a shielding member 73 according to a modification of the third embodiment. In the tablet printing apparatus S, configuration unnecessary for the following description is not illustrated.

As illustrated in FIG. 17, a first conveyor 10 of the third embodiment includes two lanes for conveying the tablets T. That is, the first conveyor 10 includes two conveyors 101 and 102. The conveyors 101 and 102 each include at least a first pulley, a second pulley, conveyor belt, and a suction chamber as constituent elements.

The conveyor 101 is located on the right side in FIG. 17, i.e., in the back in the front view of the tablet printing apparatus S in FIG. 1 as an example. On the other hand, the conveyor 102 is located on the left side in FIG. 17, i.e., in front in the front view of the tablet printing apparatus S in FIG. 1.

The tablets T are placed on the conveyors 101 and 102 constituting the two lanes, and conveyed to below the printing head H to be subjected to the printing process. In FIG. 17, the tablet T is conveyed from the back to front of the drawing. The print head H straddles the conveyors 101 and 102, and performs printing on the tablet T placed on each of the conveyors 101 and 102.

Directly below the print head H, the shielding member 73 extending in the vertical direction is provided between the conveyors 101 and 102 so as to be along the conveyance direction of the tablet T. The shielding member 73 is arranged such that the influence of airflow does not occur due to the movement of air between the adjacent conveyors 101 and 102 when air is suctioned by each of suction chambers 147 and 148.

In FIG. 17, the tablet T is illustrated immediately below the print head H in each of the conveyors 101 and 102, however, the tablet T is not always present. For example, there ire cases where the tablet T is not present in the conveyor 101 depending on the upstream conveyance state, and the tablet T is present only in the conveyor 102. In this case, in the conveyor 101, the suction chamber 147 performs suction undisturbed by the tablet T. At this time, the range and flow rate of the airflow due to the suction are larger than those when the tablet T is present. Therefore, it affects the printing process performed in the adjacent conveyor 102.

However, since the shielding member 73 is arranged between the conveyors 101 and 102, the airflow due to the suction in the conveyor 101 is blocked by the shielding member 73, and the influence of the airflow does not occur on the conveyor 102 side.

The length of the shielding member 73 in the vertical direction from directly below the print head H is set arbitrarily taking into account such conditions as the distance between the adjacent conveyors 101 and 102, the suction force at the time of suction of air by each of the suction chambers 147 and 148 for sucking and holding the tablet T, and the like.

The shielding member 73 may be provided to the print head H and extend in the vertical direction from the surface thereof. Besides, for example, if a fixing member for fixing the shielding member 73 is arranged between the adjacent conveyors 101 and 102, the shielding member 73 can be fixed to the fixing member such that it extends in the vertical direction toward the print head H.

As described above, the shielding member 73 is provided in the vicinity of the surface of the print head H for preventing the influence of the airflow. Thereby, the suction of air for sucking and holding the tablet T can be appropriately controlled. Thus, it is possible to provide a tablet printing apparatus S and a tablet printing method capable of ensuring stable ejection of ink and maintaining the printing quality.

In the example described above, there are two lanes for conveying the tablets T, i.e., there are two conveyors. However, the shielding member 73 may be provided in any case such as, for example, when the tablets T are conveyed with three or more conveyors and the like.

Fourth Embodiment

Next, a fourth embodiment will be described with reference to FIG. 18. In the fourth embodiment, like reference numerals designate like constituent elements as those described in the first to third embodiments, and the same description will not be repeated.

Figure 18:
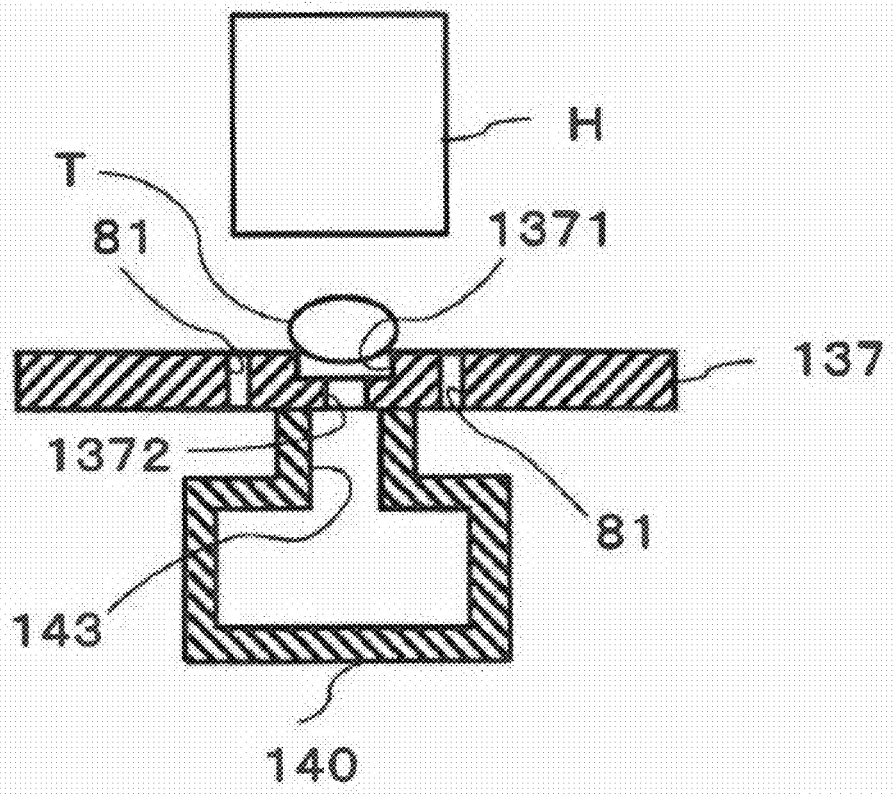
FIG. 18 is a cross-sectional view illustrating an air supply port according to a fourth embodiment together with a print head and a conveyor belt.

FIG. 18 is a cross-sectional view illustrating an air supply port 81, which is provided in the first region for rectifying the airflow caused by the suction force, together with the print head H and a conveyor belt 137 according to the fourth embodiment. In FIG. 18, for the sake of convenience of description, the section is illustrated so as to include the first region in the conveyor belt 137. The print head H is located such that its long sides are perpendicular to the conveyance direction of the conveyor belt 137 in the horizontal plane.

In the conveyor belt 137, a groove-shaped recess 1371 is formed substantially at the center in the short side direction. The tablet T is placed so as to straddle the recess 1371. A suction hole 1372, which is a through hole penetrating to the back surface of the conveyor belt 137, is formed on the bottom surface of the recess 1371. The recess 1371 and the suction hole 1372 constitute a suction portion for the tablet T.

The suction groove 143 of a suction chamber 140 is located directly below the suction hole 1372. Thereby, suction force is applied to the tablet T placed on the recess 1371 through the suction groove 143. The air supply port 81 is provided to the vicinity of the recess 1371 of the conveyor belt 137, in FIG. 18, both sides of the recess 1371. The air supply ports 81 are arranged in a direction horizontally perpendicular to the conveyance direction of the conveyor belt 137.

As described above, as the suction chamber 140 sucks air, air flows, for example, from the vicinity of the print head H toward the recess 1371. The stronger the suction force of the suction chamber 140 is, the more airflow is generated. Accordingly, the flying direction of the ink ejected from the print head H is bent under the influence of the airflow, and the deposit position is displaced. That is, printing is not performed correctly.

Therefore, the influence of the airflow is suppressed by reducing the amount of air sucked from a space between the print head H and the conveyor belt 137 in the upper part of the suction groove 143. Specifically, in order to reduce the amount of air sucked from the vicinity of the print head H in the upper part of the suction groove 143, air can be supplied from the air supply port 81 to the recess 1371.

Since air to be sucked is supplied to the recess 1371 from the air supply port 81, the air sucked through the recess 1371 flows from the air supply port 81 to the recess 1371 along the surface of the conveyor belt 137 and creates a main flow. That is, the airflow caused by the suction force is rectified. This makes it possible to reduce the mount of air that passes through the side surface of the tablet T from the vicinity of the print head H and is sucked into the recess 1371. Thus, the air supply port 81 functions as a suction force adjusting device.

In this manner, the amount of air passing through the side surface of the tablet T from the vicinity of the print head H far from the printing surface is reduced. Thereby, it is possible to suppress the influence on the flight of the ink ejected from the print head H during the printing process. As a result, it is possible to reduce the occurrence of printing defects in the printing process due to the collapse of the shape of the ink ejected from the print head H and flying caused by the airflow, or the displacement of the deposit position caused by the influence on the flying direction. This also prevents cases where the influence of the airflow reaches the vicinity of the nozzle of the print head H for ejecting ink and the ink around the nozzle is dried, which causes ejection defects, resulting in the degradation of the printing quality. Besides, it is possible to prevent the ink, which has not been deposited on the tablet T, from scattering like mist and adhering to the side surface of the tablet T being conveyed.

As described above, according to the fourth embodiment, an opening is provided around the suction portion as the air supply port 81. Therefore, the air sucked into the suction portion is mainly supplied from the opening around the suction portion. With this, it is possible to reduce the amount of air flowing from the vicinity of the print head H toward the suction portion. As a result, printing can be less affected by the airflow due to suction while the suction force necessary for sucking and holding the tablet T is maintained. Thus, a tablet printing apparatus S and a tablet printing method with high print quality can be provided.

The opening provided around the suction portion may be a hole as described above, or an intermittent through groove may be provided around the suction portion. Naturally, the suction portion may be a groove or a hole. The same effects as described above can be obtained.

Other Embodiments

The above embodiments can be implemented in various other forms, and various omissions, replacements, and modifications can be made without departing from the scope of the invention.

For example, in the first conveyor 1 illustrated in FIG. 2, one (one array) of the suction portions 130 of the conveyor belt 13 is provided in the width direction center of the conveyor belt 13; however, there may be a plurality (a plurality of arrays) of the suction portions 130. That is, there may be a plurality of conveyance lines for conveying the tablets T on one conveyor belt 13. Besides, as illustrated in FIG. 17, one conveyor 101 or 102 may be provided with a plurality of conveyor belts 135 or 136, and there may be a plurality of conveyance lines for conveying the tablets T on each of the conveyor belts 135 or 136.

Figure 19:
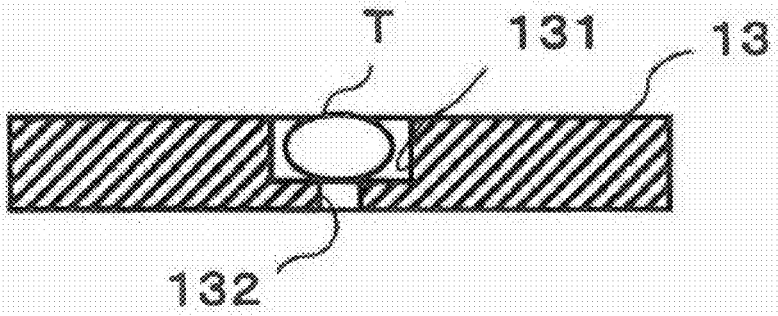
FIG. 19 is an enlarged cutaway cross-sectional view illustrating a part of another example of a conveyor belt according to another embodiment.
Figure 20:
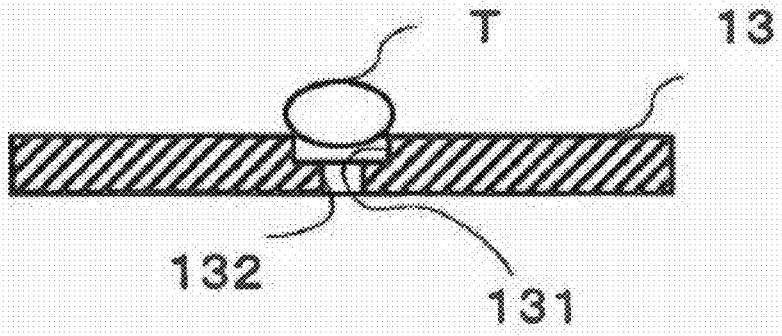
FIG. 20 is an enlarged cutaway cross-sectional view illustrating a part of another example of a conveyor belt according to another embodiment.
Figure 21:
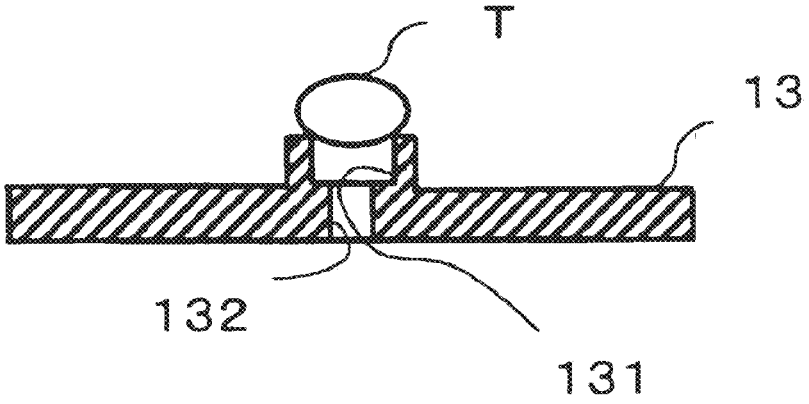
FIG. 21 is an enlarged cutaway cross-sectional view illustrating a part of another example of a conveyor belt according to another embodiment.
Figure 22:
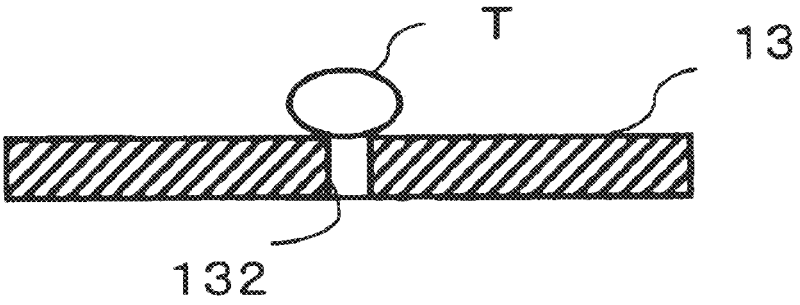
FIG. 22 is an enlarged cutaway cross-sectional view illustrating a part of another example of a conveyor belt according to another embodiment.

The size, shape, number, and the like of the suction portion provided to the conveyor belt (for example, 13, 133 to 137) are not limited. For example, as illustrated in the cross-sectional view of the suction part of the belt illustrated in FIG. 19, the tablet T may be housed in the recess 131 such as a pocket or a groove, or the tablet T may be placed on the recess 131 as illustrated in FIG. 20. Further, as illustrated in FIG. 21, the tablet T may be placed on the recess 131 such as a pocket or a groove formed of a protrusion, or as illustrated in FIG. 22, the recess 131 may not be formed and only the s action hole 132 may be formed in the conveyor belt 13. Any type of suction portion, including the above-described ones, may be used as long as it is capable of sucking and holding the tablets T.

The conveyor belt (for example, 13, 133 to) may be provided with a number of fine suction portions, or may be a belt made of a porous material. Alternatively, the belt may be mesh-like pores. In the case of such a belt, the tablets T conveyed need not necessarily be arranged in an array, but may be sucked and held randomly on the belt. In addition, the tablets T may be held by two belts with the suction portion between the two belts. The two belts may be connected to form a ladder shape. Further, when there is a larger opening around the tablet T being sucked, the influence on printing becomes larger. Therefore, reducing the airflow due to suction during printing has a greater effect. Thus, various conveying measures are available.

The suction chamber (for example, 14, 24, 140, 147, 148) need not necessarily suck in the entire circumference of the suction chamber. For example, in the case where Printing is performed only on one surface of the tablet T, one conveyor is sufficient. In this case, the tablet T is discharged around the portion where the tablet T is reversed and conveyed, and there is no need for suction since the tablet T is not present on the conveyor belt 13 up to the receiving (supplying) portion after discharging the tablet T. Besides, for example, in the case of printing on the upper and lower surfaces, of the tablet T as in the tablet printing apparatus in FIG. 1, in the first conveyor 1, after the tablet T is transferred from the first conveyor 1 to the second conveyor 2 or after the tablet T is discharged in the second conveyor 2, the tablet T is not present on the conveyor belt 13, 23 until the place where the tablet T are newly supplied. Therefore, suction is not required. It is not necessary to provide the suction chamber (for example, 14, 24, 140, 147, 148) in a place where it is not necessary to suck the tablet T such as these. For example, a part of the suction chamber 14 may not be provided in the vicinity of the driven pulley after the tablet T is transferred from the first conveyor 1 to the second conveyor 2.

The magnitude of the suction force is adjusted by adjusting the suction pressure, the air suction amount, and the air suction speed (wind speed). That is, the suction force is a concept including wind speed and pressure.

The first embodiment, in which the suction force of the suction chamber 14 is adjusted depending on the location, may be combined with other embodiments. With this, the suction force applied to the tablet T can be more finely set and adjusted according to the conveyance position.

In the first and second embodiments, the suction force is set so as not to generate an airflow that causes printing defects in the printing process. However, it is not so limited. No suction force may be applied to the tablet T at least at a conveyance position facing the print head H and positions in front of and behind the position.

As a driving element of the inkjet print head H, a piezoelectric element, a heat generating element, a magnetostrictive element, or the like can be used.

Examples of the tablet include a plain tablet (uncoated tablet), a sugar-coated tablet, a film-coated tablet, an enteric coated tablet, a gelatin coated tablet, a multilayered tablet, a dry-coated tablet, and the like. Examples of the tablet further include various capsule tablets such as hard capsules and soft capsules. Examples of the tablet may include those for pharmaceutical use, edible use, cleaning use, industrial use, and aromatic use.

In the case where tablets to be printed are for pharmaceutical use and edible use, edible ink is suitably used. Specifically, edible pigment such as Amaranth, Erythrosine, New Coccine (red pigment), Tartrazine, Sunset Yellow FCF, β-Carotene, Crocin (yellow pigment), Brilliant Blue FCF, Indigo Carmine (blue pigment), or the like is dispersed or dissolved in a vehicle, and, if necessary, a pigment dispersant (surfactant) is blended therein, the resultant of which can be used. As the edible ink, any of synthetic color ink, natural color ink, dye ink, and pigment ink may be used.

The embodiment and its variations described above are included in the scope and gist of the invention and are included in the invention described in the claims and the equivalent scope thereof.

EXPLANATION OF SYMBOLS

1 First conveyor
2 Second conveyor
14, 24 Suction chamber
141 Chamber body
142 Suction path
143 Suction groove
144 Partition wall
145 First section
146 Second section
42 Position detector
33, 43 Printing t checking device
61 Suction force lowering member
71 to 73 Shielding member
81 Air supply port
H Print head
T Tablet

The invention claimed is:

1. A tablet printing apparatus, comprising:

a conveyor configured to convey tablets sequentially supplied thereto while sucking and holding the tablets;

a print head located to face the conveyor, and configured to eject ink to the tablet conveyed by the conveyor to perform printing;

a detector located on an upstream side of the print head in a conveyance direction of the tablet, and configured to detect posture of the tablet sucked and held on the conveyor; and a suction force adjuster configured to reduce a suction force applied to the tablet, wherein the suction force adjuster is configured to reduce a suction force, which is applied to the tablet in a first region between a first conveyance position and a second conveyance position, to be lower than a suction force applied to the tablet in a second region in front of and behind the first region, the first conveyance position is a predetermined position between a conveyance position where the tablet is supplied to the conveyor and a conveyance position before the tablet passes by the detector, and the second conveyance position is a position where the tablet passes by the print head, the conveyor includes a suction chamber applying a suction force to the table, an inside chamber of the suction chamber is divided into a first section corresponding to the first region and a second section corresponding to the second region, and the suction force adjuster adjusts a suction force for each section, and reduces a suction force applied to the tablet in the first section to be lower than a suction force applied to the tablet in the second section.

2. The tablet printing apparatus according to claim 1, wherein the conveyor includes a sucking portion configured to suck the tablet, and the suction force adjuster includes a suction force lowering member configured to reduce a suction force, which is applied to the tablet through the sucking portion in the first region, to be lower than a suction force applied to the tablet through the sucking portion in the second region.

3. The tablet printing apparatus according to claim 2, wherein the suction force lowering member is formed of any one of a plate-like member, a porous member, a mesh member, and a flange member, which are configured to narrow an opening of the sucking portion in the first region as compared to an opening at another position.

4. The tablet printing apparatus according to claim 1, wherein the conveyor includes a suction portion where the tablet is placed, and the suction force adjuster includes an air supply port configured to supply air to the suction portion at least at a position where the print head performs printing on the tablet.

5. The tablet printing apparatus according to claim 1, further comprising a shielding member configured to shield an airflow caused by a suction force applied to the tablet at least at a position where the print head performs printing on the tablet.

6. The tablet printing apparatus according to claim 3, wherein the suction force lowering member is a wedge-shaped flange member configured to gradually narrow the opening of the sucking portion from an upstream side to a downstream side in the conveyance direction in the first region.

7. The tablet printing apparatus according to claim 3, wherein the suction force lowering member is the plate-like member configured to close part of the opening of the sucking portion such that the area of the part gradually increases from an upstream side to a downstream side in the conveyance direction in the first region.

8. The tablet printing apparatus according to claim 1, wherein a third section is provided under the print head in the first section, and the suction force adjuster reduces a suction force applied to the tablet in the third section to be lower than a suction force applied to the tablet in the first section excluding the third section.

9. The tablet printing apparatus according to claim 1, further comprising:

a first suction path connected to the first section; and a second suction path connected to the second section, the second suction path being different from the first suction path.

10. A tablet printing method, comprising:

conveying, by a conveyor, tablets sequentially supplied while sucking and holding the tablets;

ejecting, from a print head, ink to the tablet conveyed as being sucked and held to perform printing;

detecting posture of each of the tablets by a detector located on an upstream side of the print head in a conveyance direction of the tablet; and reducing a suction force applied to the tablet in a first region between a first conveyance position and a second conveyance position, to be lower than a suction force applied to the tablet in a second region in front of and behind the first region, wherein the first conveyance position is a predetermined position between a conveyance position where the tablet is supplied to the conveyor and a conveyance position before the tablet passes by the detector, and the second conveyance position is a position where the tablet passes by the print head, wherein the conveyor includes a suction chamber applying the suction force to the tablet, an inside of the suction chamber is divided into a first section corresponding to the first region and a second section corresponding to the second region, and in the step of reducing the suction force, a suction force for each section is adjusted so that a suction force applied to the tablet in the first section is lower than a suction force applied to the tablet in the second section.

* * * * *